US009214072B2

(12) United States Patent
Saunders

(10) Patent No.: US 9,214,072 B2
(45) Date of Patent: Dec. 15, 2015

(54) GAMING SYSTEM AND METHOD PROVIDING A SLOT GAME HAVING A SURROUNDED SYMBOL AWARD EVALUATION

(71) Applicant: IGT, Las Vegas, NV (US)

(72) Inventor: Brian F. Saunders, Sunnyvale, CA (US)

(73) Assignee: IGT, Las Vegas, NV (US)

( * ) Notice: Subject to any disclaimer, the term of this patent is extended or adjusted under 35 U.S.C. 154(b) by 120 days.

(21) Appl. No.: 14/022,854

(22) Filed: Sep. 10, 2013

(65) Prior Publication Data

US 2015/0072753 A1 Mar. 12, 2015

(51) Int. Cl.

| | |
|---|---|
| ***A63F 9/24*** | (2006.01) |
| ***G07F 17/34*** | (2006.01) |
| ***G07F 17/32*** | (2006.01) |

(52) U.S. Cl.

CPC ..... *G07F 17/34* (2013.01); *G07F 17/3267* (2013.01)

(58) Field of Classification Search

CPC .. G07F 17/3267; G07F 17/3213; G07F 17/34
See application file for complete search history.

(56) References Cited

U.S. PATENT DOCUMENTS

| | | | |
|---|---|---|---|
| 5,976,016 | A | 11/1999 | Moody et al. |
| 6,093,102 | A | 7/2000 | Bennett |
| 6,095,921 | A | 8/2000 | Walker et al. |
| 6,120,378 | A | 9/2000 | Moody et al. |
| 6,346,043 | B1 | 2/2002 | Colin et al. |
| 6,511,375 | B1 | 1/2003 | Kaminkow |
| 6,602,137 | B2 | 8/2003 | Kaminkow et al. |
| 6,733,386 | B2 | 5/2004 | Cuddy et al. |
| 6,749,502 | B2 | 6/2004 | Baerlocher |
| 6,869,357 | B2 | 3/2005 | Adams |
| 6,910,962 | B2 | 6/2005 | Marks et al. |
| 6,932,701 | B2 | 8/2005 | Glavich et al. |
| 6,958,013 | B2 | 10/2005 | Miereau et al. |
| 7,108,602 | B2 | 9/2006 | Daly |
| 7,160,189 | B2 | 1/2007 | Walker et al. |
| 7,300,348 | B2 | 11/2007 | Kaminkow et al. |
| 7,314,409 | B2 | 1/2008 | Maya et al. |
| 7,371,168 | B2 | 5/2008 | Bilyeu et al. |
| 7,371,170 | B2 | 5/2008 | Cregan et al. |
| 7,393,277 | B2 | 7/2008 | Jackson |
| 7,399,226 | B2 | 7/2008 | Mishra |

(Continued)

FOREIGN PATENT DOCUMENTS

WO WO 2005079936 A1 * 9/2005

*Primary Examiner* — Steve Rowland
(74) *Attorney, Agent, or Firm* — Neal, Gerber & Eisenberg LLP

(57) ABSTRACT

Various embodiments of the present disclosure provide a gaming system and method providing a slot game having a surrounded symbol award evaluation. Generally, in various embodiments, for a play of the slot game having the surrounded symbol award evaluation the gaming system: (a) displays a plurality of symbols at a plurality of symbol display areas; (b) determines whether any displayed non-enclosing symbols are surrounded by a plurality of displayed enclosing symbols; and (c) if so, determines any awards based on the surrounded non-enclosing symbol(s). Thus, instead of (or in addition to) using a payline evaluation, a ways-to-win evaluation, a scatter pay evaluation, or any other evaluation of the displayed symbols to determine whether to provide any awards, the gaming system of the present disclosure does so by determining whether a particular type of symbol (such as an enclosing symbol) surrounds another type of symbol (such as a non-enclosing symbol).

23 Claims, 21 Drawing Sheets

(56) References Cited

U.S. PATENT DOCUMENTS

| | | | |
|---|---|---|---|
| 7,413,510 | B2 | 8/2008 | Schlegel et al. |
| 7,494,413 | B2 | 2/2009 | Singer et al. |
| 7,578,735 | B2 | 8/2009 | Frizzell et al. |
| 7,585,219 | B2 | 9/2009 | Randall et al. |
| 7,594,849 | B2 | 9/2009 | Cannon |
| 7,601,061 | B2 | 10/2009 | Jackson |
| 7,601,062 | B2 | 10/2009 | Cole et al. |
| 7,874,908 | B2 | 1/2011 | Walker et al. |
| 7,909,690 | B2 | 3/2011 | Low |
| 7,914,376 | B2 | 3/2011 | Walker et al. |
| 7,922,573 | B2 | 4/2011 | Baerlocher et al. |
| 8,043,153 | B2 | 10/2011 | Ross et al. |
| 8,066,564 | B2 | 11/2011 | Randall |
| 8,092,290 | B2 | 1/2012 | Darby |
| 8,128,480 | B2 | 3/2012 | Muir |
| 8,172,665 | B2 | 5/2012 | Hoffman et al. |
| 8,221,206 | B2 | 7/2012 | Marks et al. |
| 8,241,104 | B2 | 8/2012 | Wolf |
| 8,277,302 | B2 | 10/2012 | Walker et al. |
| 8,287,364 | B2 | 10/2012 | Caputo et al. |
| 8,430,739 | B2 | 4/2013 | Rodgers |
| 2003/0130025 | A1 | 7/2003 | Gilmore et al. |
| 2004/0192431 | A1 | 9/2004 | Singer et al. |
| 2004/0195773 | A1 | 10/2004 | Masci et al. |
| 2005/0054418 | A1 | 3/2005 | Baerlocher |
| 2006/0084497 | A1 | 4/2006 | Marks et al. |
| 2006/0111170 | A1 | 5/2006 | Hornik et al. |
| 2006/0121969 | A1 | 6/2006 | Marks et al. |
| 2006/0183535 | A1 | 8/2006 | Marks et al. |
| 2006/0205473 | A1 | 9/2006 | Gomez et al. |
| 2006/0252506 | A1 | 11/2006 | Walker et al. |
| 2007/0060255 | A1 | 3/2007 | Baerlocher et al. |
| 2009/0227337 | A1 | 9/2009 | Langille et al. |
| 2010/0048282 | A1 | 2/2010 | Nicely et al. |
| 2011/0111828 | A1 | 5/2011 | Caputo et al. |
| 2013/0079098 | A1 | 3/2013 | Nicely et al. |

* cited by examiner

FIG. 8

1116,1118

| | | | | | | | | | |
|---|---|---|---|---|---|---|---|---|---|
| 720a X 710a | 720b A 710b | 720c X 710c | 720d Y 710d | 720e X 710e | 720f X 710f | 720g Z 710g | 720h Y 710h | 720i Y 710i | 720j A 710j |
| 720k A 710k | 720l C 710l | 720m B 710m | 720n A 710n | 720o X 710o | 720p A 710p | 720q C 710q | 720r Y 710r | 720s C 710s | 720t A 710t |
| 720u C 710u | 720v Y 710v | 720w X 710w | 720x B 710x | 720y X 710y | 720z Z 710z | 720aa Y 710aa | 720bb Y 710bb | 720cc Z 710cc | 720dd X 710dd |
| 720ee B 710ee | 720ff C 710ff | 720gg A 710gg | 720hh C 710hh | 720ii Z 710ii | 720jj A 710jj | 720kk C 710kk | 720ll B 710ll | 720mm X 710mm | 720nn Z 710nn |
| 720oo Z 710oo | 720pp X 710pp | 720qq A 710qq | 720rr X 710rr | 720ss Y 710ss | 720tt Z 710tt | 720uu X 710uu | 720vv Y 710vv | 720ww Z 710ww | 720xx A 710xx |

| 770 | 780 | 790 |
|---|---|---|
| 210 Credits | 10 Credits | 44 Credits |
| Balance | Bet | Award |

760

You win 10 credits for each surrounded X and each surrounded A,
5 credits for each surrounded Y and each surrounded B, and
2 credits for each surrounded C for a total award of 44 credits!

GAMING SYSTEM AND METHOD PROVIDING A SLOT GAME HAVING A SURROUNDED SYMBOL AWARD EVALUATION

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming systems (such as electronic gaming machines (EGMs)) that provide players awards in primary or base games are well known. These gaming systems generally require a player to place a wager to activate a play of the primary game. For gaming system configured to operate a slot or spinning-reel type game, there are a variety of known ways in which the gaming systems may evaluate displayed symbols to determine whether to provide any awards for a play of the slot game. One known manner of doing so includes the gaming system evaluating the displayed symbols to determine whether any winning symbols or winning symbol combinations are displayed along one or more paylines. Another known manner of doing so includes the gaming system determining whether any scatter pay symbols are displayed. Another known manner of doing so includes the gaming system performing a ways-to-win evaluation of the displayed symbols. Each of these award evaluations is described below.

One known gaming system is configured to operate a slot game associated with a plurality of reels and one or more paylines. The slot game may be associated with any suitable number of reels, such as three to five reels, which each include any suitable number of symbols and are configured to display one or more of those symbols at one or more symbol display areas. The gaming system initiates a spin of the reels upon receiving one or more wagers on one or more paylines associated with the slot game. The slot game may be associated with one, three, five, nine, fifteen, twenty-five, or any other suitable number of paylines that are horizontal, vertical, diagonal, or any combination thereof and are associated with one or more of the symbol display areas. One slot game includes a different payline associated with each possible combination of symbol display areas.

The gaming system spins and stops the reels such that a symbol is displayed at each symbol display area. The gaming system analyzes the displayed symbols to determine if the any winning symbols or winning combinations of the symbols are displayed on or along one or more of the wagered-on paylines. The gaming system provides any awards associated with any displayed winning symbols or winning symbol combinations to the player. More specifically, in such slot games, the gaming system generally determines the awards based on the number of wagered-on paylines that pass through each of the winning symbol combinations. That is, the gaming system separately analyzes each wagered-on payline to determine if a winning symbol combination is displayed along that payline. For each occurrence of each payline passing through a winning symbol combination, the gaming system provides the player the award associated with that winning symbol combination. For example, in a five reel slot game, if four related symbols (that form a winning symbol combination) are generated by the first four reels and twelve paylines pass through the first three of those related symbols (i.e., three paylines running left to right pass through all four related symbols and nine paylines running left to right pass through the first three related symbols), the gaming system provides the player twelve awards (i.e., one award for each payline that passes through the winning symbol combination). These twelve separate awards are each for the single occurrence of the winning symbol combination including the four related symbols. Accordingly, the greater the number of wagered-on paylines that pass through a winning symbol combination, the greater the award as compared to an identical winning symbol combination in which fewer wagered-on paylines pass through the same winning symbol combination.

In another type of gaming system configured to operate a slot game (that may or may not be associated with paylines), the gaming system analyzes the displayed symbols to determine if the gaming system has randomly generated and displayed a designated quantity of one or more scatter pay symbols. In this type of scatter pay award evaluation, the location of the designated quantity of displayed scatter pay symbols does not matter as long as those scatter pay symbols are displayed. The gaming system provides any awards associated with any displayed scatter pay symbols to the player.

In another type of gaming system configured to operate a slot game, the gaming system enables the player to wager on a number of ways to win, wherein any award provided to the player is based on the number of associated symbols that are generated in active symbol display areas on a requisite number of adjacent reels. In such ways to win slot games, the gaming system determines any award to provide to the player based on the number of associated symbols that are generated in active symbol display areas on a requisite number of adjacent reels (i.e., not on paylines passing through any displayed winning symbol combinations).

In some known ways to win slot games, the gaming system determines the total number of ways to win by multiplying the number of symbols generated in active symbol display areas on a first reel by the number of symbols generated in active symbol display areas on a second reel by the number of symbols generated in active symbol display areas on a third reel and so on for each reel associated with the slot game with at least one symbol generated in an active symbol display area. For example, a three reel slot game with three symbols generated in active symbol display areas on each reel includes 27 ways to win (i.e., 3 symbols on the first reel×3 symbols on the second reel×3 symbols on the third reel). A four reel slot game with three symbols generated in active symbol display areas on each reel includes 81 ways to win (i.e., 3 symbols on the first reel×3 symbols on the second reel×3 symbols on the third reel×3 symbols on the fourth reel). A five reel slot game with three symbols generated in active symbol display areas on each reel includes 243 ways to win (i.e., 3 symbols on the first reel×3 symbols on the second reel×3 symbols on the third reel×3 symbols on the fourth reel×3 symbols on the fifth reel). Modifying the number of generated symbols by either modifying the number of reels or modifying the number of symbols generated in active symbol display areas by one or more of the reels modifies the number of ways to win.

There is a continuing need to provide new and exciting manners of evaluating symbols to determine awards to increase player enjoyment, entertainment, and excitement.

SUMMARY

Various embodiments of the present disclosure provide a gaming system and method providing a slot game having a surrounded symbol award evaluation. Generally, in various embodiments, for a play of the slot game having the surrounded symbol award evaluation the gaming system: (a) displays a plurality of symbols at a plurality of symbol display areas; (b) determines whether any displayed non-enclosing symbols are surrounded (i.e., enclosed) by a plurality of displayed enclosing symbols; and (c) if so, determines any awards based on the surrounded non-enclosing symbol(s). Thus, instead of (or in addition to) using a payline evaluation, a ways-to-win evaluation, a scatter pay evaluation, or any other evaluation of the displayed symbols to determine whether to provide any awards for the play of the slot game, the gaming system of the present disclosure does so by determining whether a particular type of symbol (such as an enclosing symbol) surrounds another type of symbol (such as a non-enclosing symbol).

More specifically, for a play of the slot game having the surrounded symbol award evaluation in one embodiment, the gaming system provides (such as displays) a plurality of symbol display areas. For each of the symbol display areas, the gaming system displays one of a plurality of different symbols at that symbol display area. The plurality of different symbols include a plurality of enclosing symbols and a plurality of non-enclosing symbols. The gaming system determines whether any displayed non-enclosing symbols are surrounded by a plurality of displayed enclosing symbols. If at least one displayed non-enclosing symbol is surrounded by a plurality of displayed enclosing symbols, the gaming system determines any awards associated with that at least one surrounded non-enclosing symbol and displays any determined awards.

It should thus be appreciated that the gaming system and method of the present disclosure provide a new way to evaluate displayed symbols to determine whether to provide any awards, which increases player enjoyment, entertainment, and excitement.

Additional features and advantages are described herein, and will be apparent from, the following Detailed Description and the Figures.

BRIEF DESCRIPTION OF THE FIGURES

FIG. 8 illustrates a screenshot of an outcome of a play of another example embodiment of the slot game employing the surrounded symbol award evaluation.

DETAILED DESCRIPTION

Surrounded Symbol Award Evaluation

Various embodiments of the present disclosure provide a gaming system and method providing a slot game having a surrounded symbol award evaluation. Generally, in various embodiments, for a play of the slot game having the surrounded symbol award evaluation the gaming system: (a) displays a plurality of symbols at a plurality of symbol display areas; (b) determines whether any displayed non-enclosing symbols are surrounded (i.e., enclosed) by a plurality of displayed enclosing symbols; and (c) if so, determines any awards based on the surrounded non-enclosing symbol(s). Thus, instead of (or in addition to) using a payline evaluation, a ways-to-win evaluation, a scatter pay evaluation, or any other evaluation of the displayed symbols to determine whether to provide any awards for the play of the slot game, the gaming system of the present disclosure does so by determining whether a particular type of symbol (such as an enclosing symbol) surrounds another type of symbol (such as a non-enclosing symbol).

While the slot game having the surrounded symbol award evaluation of the present disclosure is employed as a primary wagering game in the embodiments described below, it should be appreciated that the slot game may additionally or alternatively be employed as or in association with a bonus game or a secondary game. While any credit balances, any wagers, and any awards are displayed as amounts of monetary currency or credits in the embodiments described below, one or more of such credit balances, such wagers, and such awards may be for any suitable non-monetary credits or currency, promotional credits, and/or player tracking points or credits.

Manners in which a Symbol May be Surrounded

In various embodiments, the gaming system determines that a displayed non-enclosing symbol is surrounded by a plurality of displayed enclosing symbols when a continuous or unbroken chain of adjacent symbol display areas that each display an enclosing symbol surrounds the symbol display area of the displayed non-enclosing symbol.

Figure 1A:
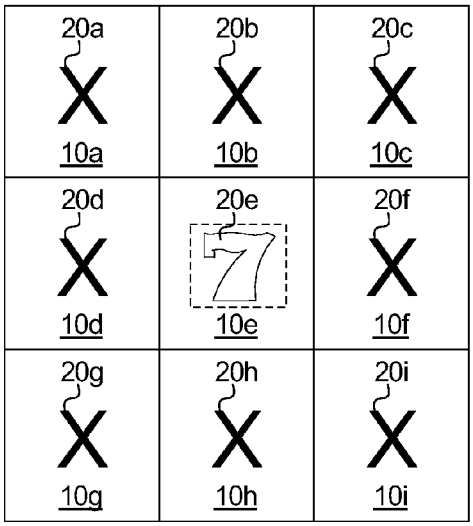
FIGS. 1A, 1B, 1C, and 1D illustrate screenshots of different outcomes of plays of various example embodiments of the slot game employing different manners of determining whether a displayed non-enclosing symbol is surrounded by a plurality of displayed enclosing symbols.

FIG. 1A illustrates a screenshot of an example of one such embodiment. In this example embodiment, the gaming system determines that a displayed non-enclosing Seven symbol 20*e* is surrounded by a plurality of displayed enclosing X symbols 20*a*, 20*b*, 20*c*, 20*f*, 20*i*, 20*h*, 20*g*, and 20*d* because the respective symbol display areas 10*a*, 10*b*, 10*c*, 10*f*, 10*i*, 10*h*, 10*g*, and 10*d* of those displayed enclosing X symbols form a continuous chain of adjacent symbol display areas that surround the symbol display area 10*e* of the displayed non-enclosing Seven symbol 20*e*.

In certain embodiments, the gaming system determines that a displayed non-enclosing symbol is surrounded by a plurality of displayed enclosing symbols when: (a) the symbol display area of the displayed non-enclosing symbol is, on all sides, orthogonally adjacent to another symbol display area; and (b) an enclosing symbol is displayed at each such symbol display area orthogonally adjacent to the symbol display area of the displayed non-enclosing symbol. Put differently, in this example embodiment, if the symbol display areas immediately above, below, to the left of, and to the right of a symbol display area of a displayed non-enclosing symbol each display an enclosing symbol, the gaming system determines that those displayed enclosing symbols surround that displayed non-enclosing symbol. If, on the other hand: (a) at least one of the symbol display areas immediately above, below, to the left of, and to the right of a symbol display area of a displayed non-enclosing symbol does not display an enclosing symbol; and/or (b) there is no symbol display area to the left of, and/or to the right of a symbol display area of a displayed non-enclosing symbol, the gaming system determines that that displayed non-enclosing symbol is not surrounded by a plurality of displayed enclosing symbols.

Figure 1B:
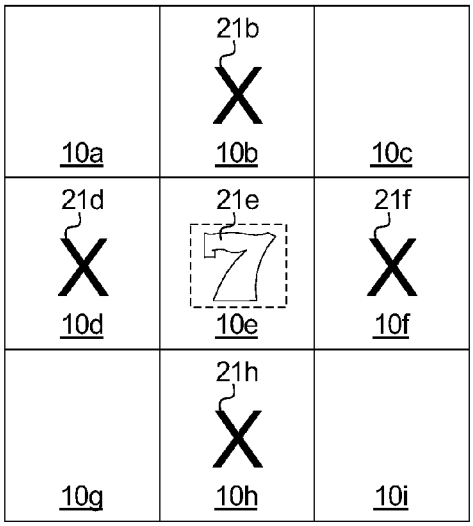

FIG. 1B illustrates a screenshot of an example of one such embodiment. In this example embodiment, the gaming system determines that a displayed non-enclosing Seven symbol 21*e* is surrounded by a plurality of displayed enclosing X symbols 21*b*, 21*f*, 21*h*, and 21*d* because: (a) the symbol display area 10*e* of the displayed non-enclosing Seven symbol 21*e* is, on all sides, orthogonally adjacent to another symbol display area (i.e., symbol display areas 10*b*, 10*f*, 10*h*, and 10*d*); and (b) each symbol display area orthogonally adjacent to the symbol display area 10*e* of the displayed non-enclosing Seven symbol 21*e* displays an enclosing X symbol.

In various embodiments, the gaming system determines that a displayed non-enclosing symbol is surrounded by a plurality of displayed enclosing symbols when: (a) the symbol display area of the displayed non-enclosing symbol is, on all sides, diagonally adjacent to another symbol display area; and (b) an enclosing symbol is displayed at each such symbol display area diagonally adjacent to the symbol display area of the displayed non-enclosing symbol.

Figure 1C:
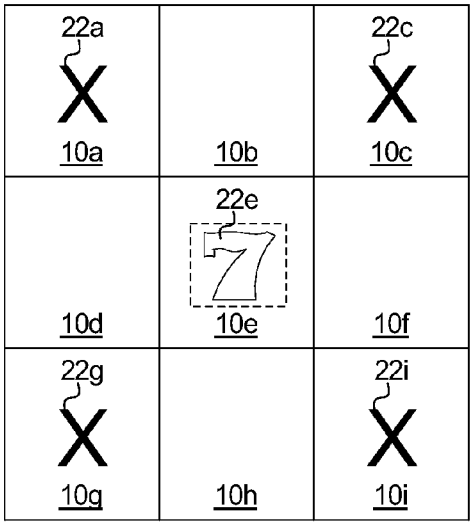

FIG. 1C illustrates a screenshot of an example of one such embodiment. In this example embodiment, the gaming system determines that a displayed non-enclosing Seven symbol 22*e* is surrounded by a plurality of displayed enclosing X symbols 22*a*, 22*c*, 22*g*, and 22*i* because: (a) the symbol display area 10*e* of the displayed non-enclosing Seven symbol 21*e* is, on all sides, diagonally adjacent to another symbol display area (i.e., symbol display areas 10*a*, 10*c*, 10*g*, and 10*i*); and (b) each symbol display area diagonally adjacent to the symbol display area 10*e* of the displayed non-enclosing Seven symbol 21*e* displays an enclosing X symbol.

In certain embodiments, the gaming system determines that a displayed non-enclosing symbol is surrounded by a plurality of displayed enclosing symbols when, if the symbol display area of the displayed non-enclosing symbol is adjacent to a border of the grid or matrix of symbol display areas, a combination of: (a) a continuous or unbroken chain of adjacent symbol display areas that each display an enclosing symbol, and (b) the border of the symbol display area grid surround the symbol display area of the displayed non-enclosing symbol.

Figure 1D:
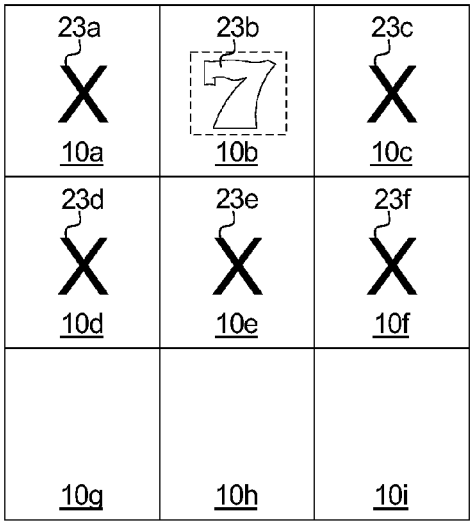

FIG. 1D illustrates a screenshot of an example of one such embodiment. In this example embodiment, the gaming system determines that a displayed non-enclosing Seven symbol 23*b* is surrounded by a plurality of displayed enclosing X symbols 23*a*, 23*d*, 23*e*, 23*f*, and 23*c* and the border of the grid of symbol display areas because: (a) the symbol display area 10*b* of the displayed non-enclosing Seven symbol 23*b* is adjacent to the border of the grid of symbol display areas, and (b) the respective symbol display areas 10*a*, 10*d*, 10*e*, 10*f*, and 10*c* of those enclosing X symbols form a continuous chain of adjacent symbol display areas that, in combination with the border, surround the symbol display area 10*b* of the non-enclosing Seven symbol 23*b*.

Example Embodiments

Figure 2:
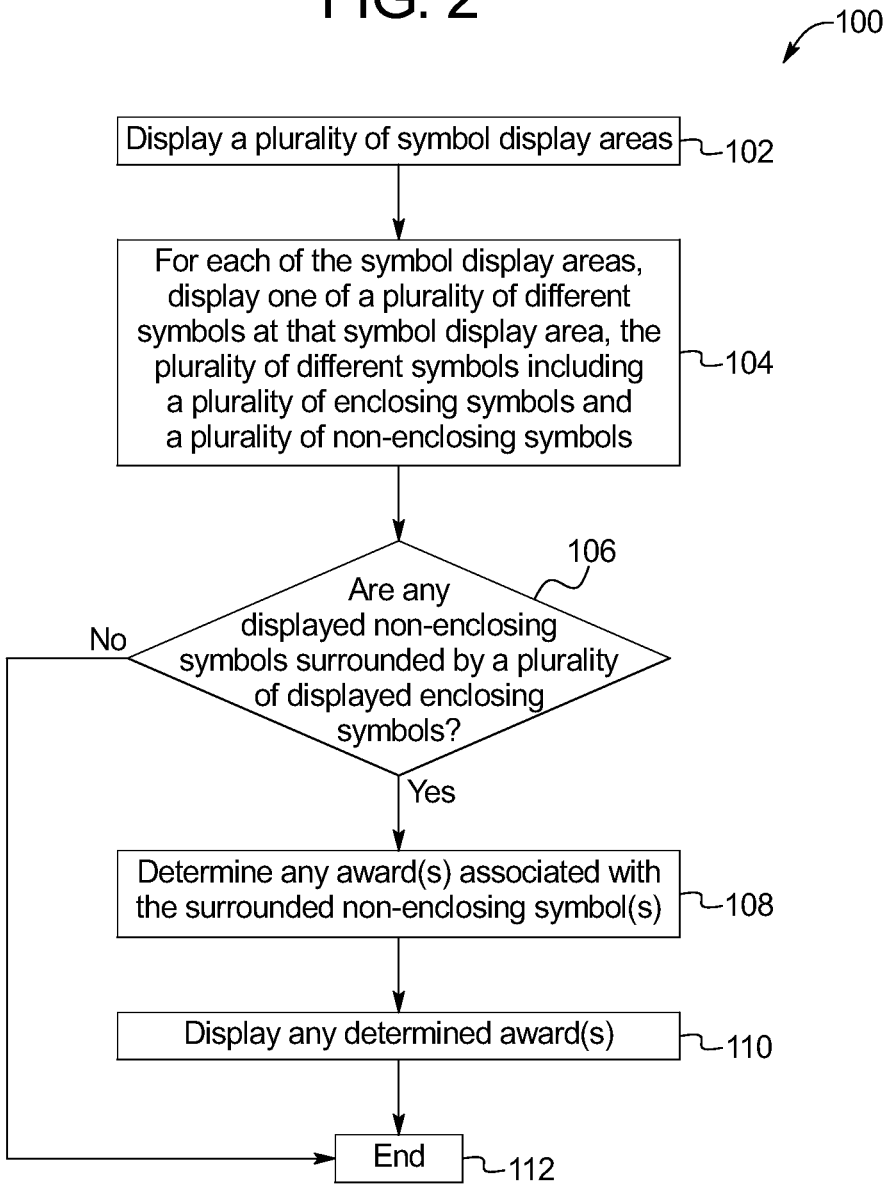
FIG. 2 is a flowchart illustrating an example method of operating one embodiment of the gaming system of the present disclosure.

FIG. 2 illustrates a flowchart of an example process or method 100 of operating one embodiment of the gaming system of the present disclosure. In various embodiments, the process 100 is represented by a set of instructions stored in one or more memories and executed by one or more processors. Although the process 100 is described with reference to the flowchart shown in FIG. 1, it should be appreciated that many other processes of performing the acts associated with this illustrated process 100 may be employed. For example, the order of certain of the illustrated blocks and/or diamonds may be changed, certain of the illustrated blocks and/or diamonds may be optional, and/or certain of the illustrated blocks and/or diamonds may not be employed.

In operation of this example embodiment, for a play of a slot game having the surrounded symbol award evaluation, the gaming system displays a plurality of symbol display areas, as indicated by block 102. For each of the symbol display areas, the gaming system displays one of a plurality of different symbols at that symbol display area, as indicated by block 104. The plurality of different symbols includes a plurality of enclosing symbols and a plurality of non-enclosing symbols. The gaming system determines whether any displayed non-enclosing symbols are surrounded by a plurality of displayed enclosing symbols, as indicated by diamond 106. In this example embodiment, the gaming system determines that a displayed non-enclosing symbol is surrounded by a plurality of displayed enclosing symbols when a continuous or unbroken chain of adjacent symbol display areas that each display an enclosing symbol surrounds the symbol display area of the displayed non-enclosing symbol.

If the gaming system determines that no displayed non-enclosing symbols (if any) are surrounded by a plurality of displayed enclosing symbols, the process 100 proceeds to block 112 and ends. If, on the other hand, the gaming system determines that at least one displayed non-enclosing symbol is surrounded by a plurality of displayed enclosing symbols, the gaming system determines any awards associated with the at least one surrounded non-enclosing symbol, as indicated by block 108. The gaming system displays any determined awards, as indicated by block 110. The process 100 then proceeds to block 112 and ends.

Figure 3A:
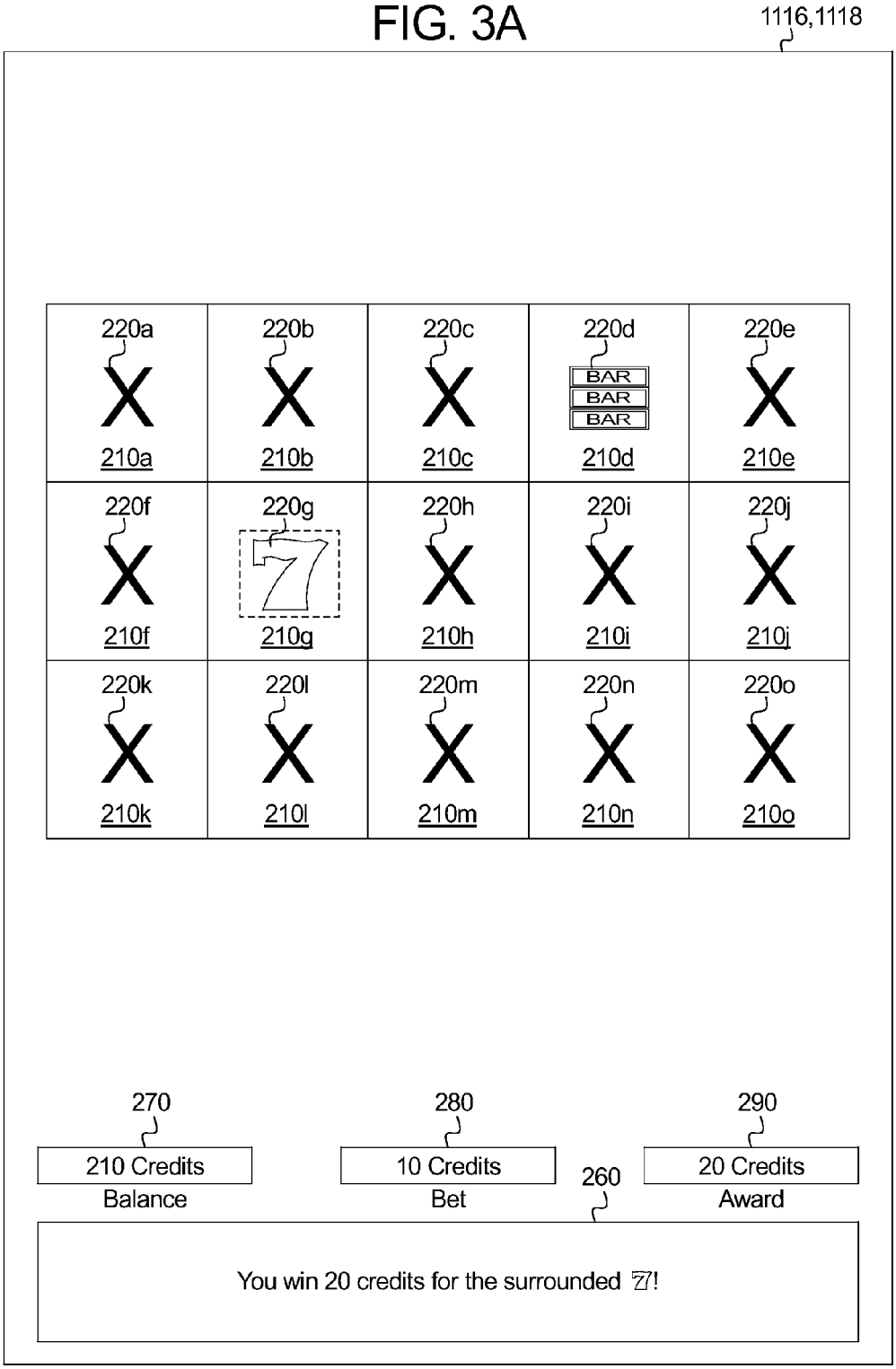
FIGS. 3A, 3B, 3C, 3D, and 3E illustrate screenshots of different outcomes of plays of various example embodiments of the slot game employing the surrounded symbol award evaluation of the present disclosure.
Figure 3B:
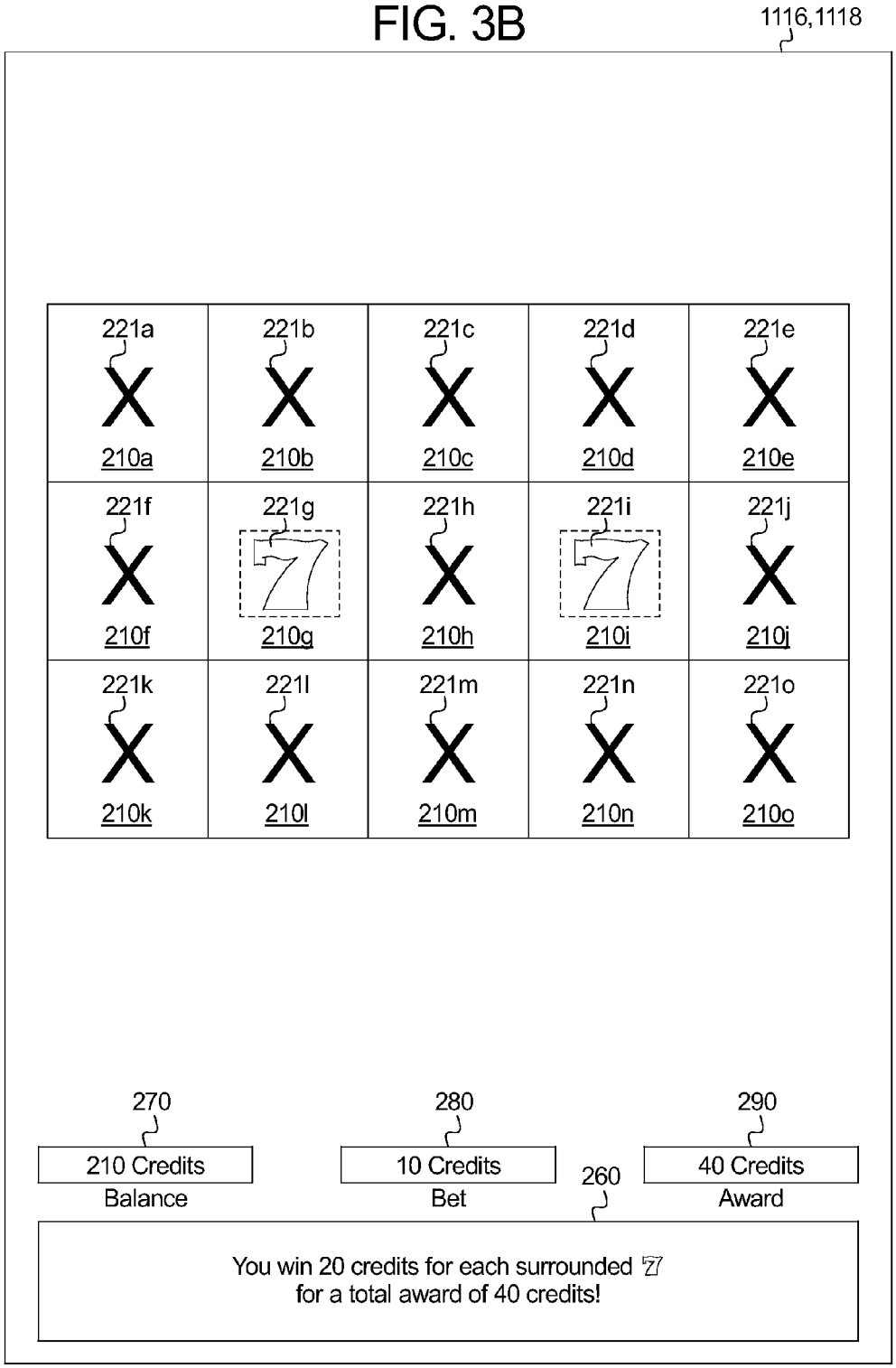
Figure 3C:
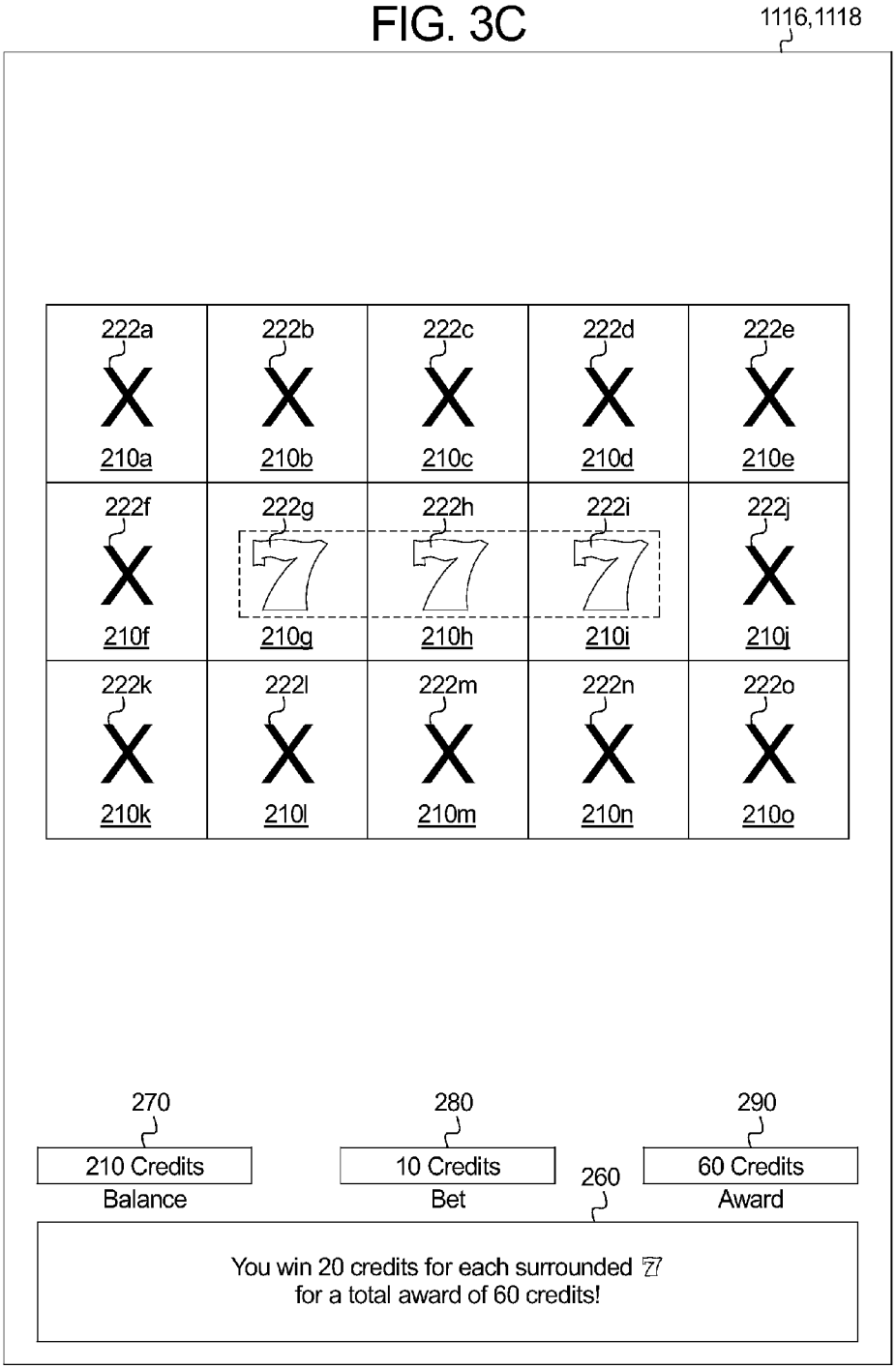

FIGS. 3A, 3B, and 3C illustrate screenshots of different outcomes of plays of one example embodiment of the slot game of the present disclosure implemented as a primary wagering game. In this example embodiment, the gaming system determines that a displayed non-enclosing symbol is surrounded by a plurality of displayed enclosing symbols when a continuous or unbroken chain of adjacent symbol display areas that each display an enclosing symbol surrounds the symbol display area of the displayed non-enclosing symbol.

In this example embodiment, the slot game is associated with a plurality of different symbols including: (a) a plurality of enclosing X symbols; and (b) a plurality of non-enclosing symbols including a non-enclosing Cherry symbol, a non-enclosing Bar symbol, a non-enclosing Triple Cherry symbol, a non-enclosing Double Bar symbol, a non-enclosing Triple Bar symbol, and a non-enclosing Seven symbol. The gaming system displays, such as on a display device 1116 or 1118 (described below), a plurality of symbol display areas including symbol display areas 210*a*, 210*b*, 210*c*, 210*d*, 210*e*, 210*f*, 210*g*, 210*h*, 210*i*, 210*j*, 210*k*, 210*l*, 210*m*, 210*n*, and 210*o* arranged in a 3×5 grid or matrix. Each of the symbol display areas is configured to display one of the symbols.

The gaming system also displays: (a) a message box 260 in which the gaming system displays a variety of messages or indications before, during, or after play of the slot game; and (b) a plurality of meters including: (i) a credit meter 270 in which the gaming system displays the player's credit balance (in credit or currency form), (ii) a wager or bet meter 280 that displays any wager or bet placed on a play of the slot game (in credit or currency form), and (iii) an award meter 290 that displays any awards won for the play of the slot game (in credit or currency form). While in this illustrated example embodiment the gaming system indicates the player's credit balance, any wagers, and any awards in the form of amounts of currency, it should be appreciated that such indications may alternatively or additionally be made in the form of amounts of credits.

Turning to FIG. 3A, the gaming system displays an outcome of a play of the slot game of this example embodiment. In this instance, the gaming system displays: (a) enclosing X symbol 220*a* at the symbol display area 210*a*, (b) enclosing X symbol 220*b* at the symbol display area 210*b*, (c) enclosing X symbol 220*c* at the symbol display area 210*c*, (d) non-enclosing Triple Bar symbol 220*d* at the symbol display area 210*d*, (e) enclosing X symbol 220*e* at the symbol display area 210*e*, (f) enclosing X symbol 220*f* at the symbol display area 210*f*, (g) non-enclosing Seven symbol 220*g* at the symbol display area 210*g*, (h) enclosing X symbol 220*h* at the symbol display area 210*h*, (i) enclosing X symbol 220*i* at the symbol display area 210*i*, (j) enclosing X symbol 220*j* at the symbol display area 210*j*, (k) enclosing X symbol 220*k* at the symbol display area 210*k*, (l) enclosing X symbol 2201 at the symbol display area 2101, (m) enclosing X symbol 220*m* at the symbol display area 210*m*, (n) enclosing X symbol 220*n* at the symbol display area 210*n*, and (o) enclosing X symbol 220*o* at the symbol display area 210*o*.

The gaming system determines whether any displayed non-enclosing symbols are surrounded by a plurality of displayed enclosing symbols as described above. Here, the gaming system determines that the non-enclosing Seven symbol 220*g* is surrounded by a plurality of enclosing X symbols 220*a*, 220*b*, 220*c*, 220*h*, 220*m*, 220*l*, 220*k*, and 220*f* because the respective symbol display areas 210*a*, 210*b*, 210*c*, 210*h*, 210*m*, 2101, 210*k*, and 210*f* of those enclosing X symbols form a continuous chain of adjacent symbol display areas that surround the symbol display area 210*g* of the non-enclosing Seven symbol 220*g*.

On the other hand, the gaming system determines that the non-enclosing Triple Bar symbol 220*d* is not surrounded by a plurality of displayed enclosing X symbols because no continuous chain of adjacent symbol display areas displaying enclosing X symbols surrounds the symbol display area 210*d* of the non-enclosing Triple Bar symbol 220*d*. Rather, a plurality of enclosing X symbols 220*c*, 220*h*, 220*i*, 220*j*, and 220*e* partially surround the non-enclosing Triple Bar symbol 220*d* because the respective symbol display areas 210*c*, 210*h*, 210*i*, 210*j*, and 210*e* of those enclosing X symbols form a non-continuous chain of adjacent symbol display areas that partially surrounds the symbol display area 210*d* of the non-enclosing Triple Bar symbol 220*d*.

The gaming system determines any awards associated with the surrounded non-enclosing symbols (if any). In this example embodiment, the gaming system determines: (a) an award of 2 credits for each surrounded non-enclosing Cherry symbol, (b) an award of 3 credits for each surrounded non-enclosing Bar symbol, (c) an award of 4 credits for each surrounded non-enclosing Triple Cherry symbol, (d) an award of 6 credits for each surrounded non-enclosing Double Bar symbol, (e) an award of 10 credits for each surrounded non-enclosing Triple Bar symbol, and (f) an award of 20 credits for each surrounded non-enclosing Seven symbol. In other words, in this example embodiment, the gaming system determines the total award for a given play of the slot game by summing the individual award associated with each surrounded non-enclosing symbol. Here, the gaming system determines an award of 20 credits associated with the single surrounded non-enclosing Seven symbol 220*g*, and displays the determined 20 credit total award in the award meter 290. The gaming system displays the following message in the message box 260: "YOU WIN 20 CREDITS FOR THE SURROUNDED 7!"

Turning to FIG. 3B, the gaming system displays an outcome of another play of the slot game of this example embodiment. In this instance, the gaming system displays: (a) enclosing X symbol 221*a* at the symbol display area 210*a*, (b) enclosing X symbol 221*b* at the symbol display area 210*b*, (c) enclosing X symbol 221*c* at the symbol display area 210*c*, (d) enclosing X symbol 221*d* at the symbol display area 210*d*, (e) enclosing X symbol 221*e* at the symbol display area 210*e*, (f) enclosing X symbol 221*f* at the symbol display area 210*f*, (g) non-enclosing Seven symbol 221*g* at the symbol display area 210*g*, (h) enclosing X symbol 221*h* at the symbol display area 210*h*, (i) non-enclosing Seven symbol 221*i* at the symbol display area 210*i*, (j) enclosing X symbol 221*j* at the symbol display area 210*j*, (k) enclosing X symbol 221*k* at the symbol display area 210*k*, (l) enclosing X symbol 2211 at the symbol display area 2101, (m) enclosing X symbol 221*m* at the symbol display area 210*m*, (n) enclosing X symbol 221*n* at the symbol display area 210*n*, and (o) enclosing X symbol 2210 at the symbol display area 2100.

The gaming system determines whether any displayed non-enclosing symbols are surrounded by a plurality of displayed enclosing symbols as described above. Here, the gaming system determines that: (a) the non-enclosing Seven symbol 221*g* is surrounded by a first plurality of enclosing X symbols 221*a*, 221*b*, 221*c*, 221*h*, 221*m*, 221*l*, 221*k*, and 221*f* because the respective symbol display areas 210*a*, 210*b*, 210*c*, 210*h*, 210*m*, 2101, 210*k*, and 210*f* of those enclosing X symbols form a continuous chain of adjacent symbol display areas that surround the symbol display area 210*g* of the non-enclosing Seven symbol 221*g*; and (b) the non-enclosing Seven symbol 2211 is surrounded by a second different plurality of enclosing X symbols 221*c*, 221*d*, 221*e*, 221*j*, 221*o*, 221*n*, 221*m*, and 221*h* because the respective symbol display areas 210*c*, 210*d*, 210*e*, 210*j*, 2100, 210*n*, 210*m*, and 210*h* of those enclosing X symbols form a continuous chain of adjacent symbol display areas that surround the symbol display area 210*i* of the non-enclosing Seven symbol 221*i*.

The gaming system determines any awards associated with the surrounded non-enclosing symbols (if any) as described above with respect to FIG. 3A. Here, the gaming system determines an award of 20 credits associated with each of the surrounded non-enclosing Seven symbols 221*g* and 221*i*, and displays the determined 40 credit total award in the award meter 290. The gaming system displays the following message in the message box 260: "YOU WIN 20 CREDITS FOR EACH SURROUNDED 7 FOR A TOTAL AWARD OF 40 CREDITS!"

Turning to FIG. 3C, the gaming system displays an outcome of another play of the slot game of this example embodiment. In this instance, the gaming system displays: (a) enclosing X symbol 222*a* at the symbol display area 210*a*, (b) enclosing X symbol 222*b* at the symbol display area 210*b*, (c) enclosing X symbol 222*c* at the symbol display area 210*c*, (d) enclosing X symbol 222*d* at the symbol display area 210*d*, (e) enclosing X symbol 222*e* at the symbol display area 210*e*, (f) enclosing X symbol 222*f* at the symbol display area 210*f*, (g) non-enclosing Seven symbol 222*g* at the symbol display area 210*g*, (h) non-enclosing Seven symbol 222*h* at the symbol display area 210*h*, (i) non-enclosing Seven symbol 222*i* at the symbol display area 210*i*, (j) enclosing X symbol 222*j* at the symbol display area 210*j*, (k) enclosing X symbol 222*k* at the symbol display area 210*k*, (l) enclosing X symbol 2221 at the symbol display area 2101, (m) enclosing X symbol 222*m* at the symbol display area 210*m*, (n) enclosing X symbol 222*n* at the symbol display area 210*n*, and (o) enclosing X symbol 222*o* at the symbol display area 2100.

The gaming system determines whether any displayed non-enclosing symbols are surrounded by a plurality of displayed enclosing symbols as described above. Here, the gaming system determines that the non-enclosing Seven symbols 222*g*, 222*h*, and 222*i* are surrounded by a plurality of enclosing X symbols 222*a*, 222*b*, 222*c*, 222*d*, 222*e*, 222*j*, 222*o*, 222*n*, 222*m*, 222*l*, 222*k*, and 222*f* because the respective symbol display areas 210*a*, 210*b*, 210*c*, 210*d*, 210*e*, 210*j*, 210*o*, 210*n*, 210*m*, 2101, 210*k*, and 210*f* of those enclosing X symbols form a continuous chain of adjacent symbol display areas that surround the symbol display areas 210*g*, 210*h*, and 210*i* of the non-enclosing Seven symbols 222*g*, 222*h*, and 222*i*.

The gaming system determines any awards associated with the surrounded non-enclosing symbols (if any) as described above with respect to FIG. 3A. Here, the gaming system determines an award of 20 credits associated each of the surrounded non-enclosing Seven symbols 222*g*, 222*h*, and 222*i*, and displays the determined 60 credit total award in the award meter 290. The gaming system displays the following message in the message box 260: "YOU WIN 20 CREDITS FOR EACH SURROUNDED 7 FOR A TOTAL AWARD OF 60 CREDITS!"

Figure 3D:
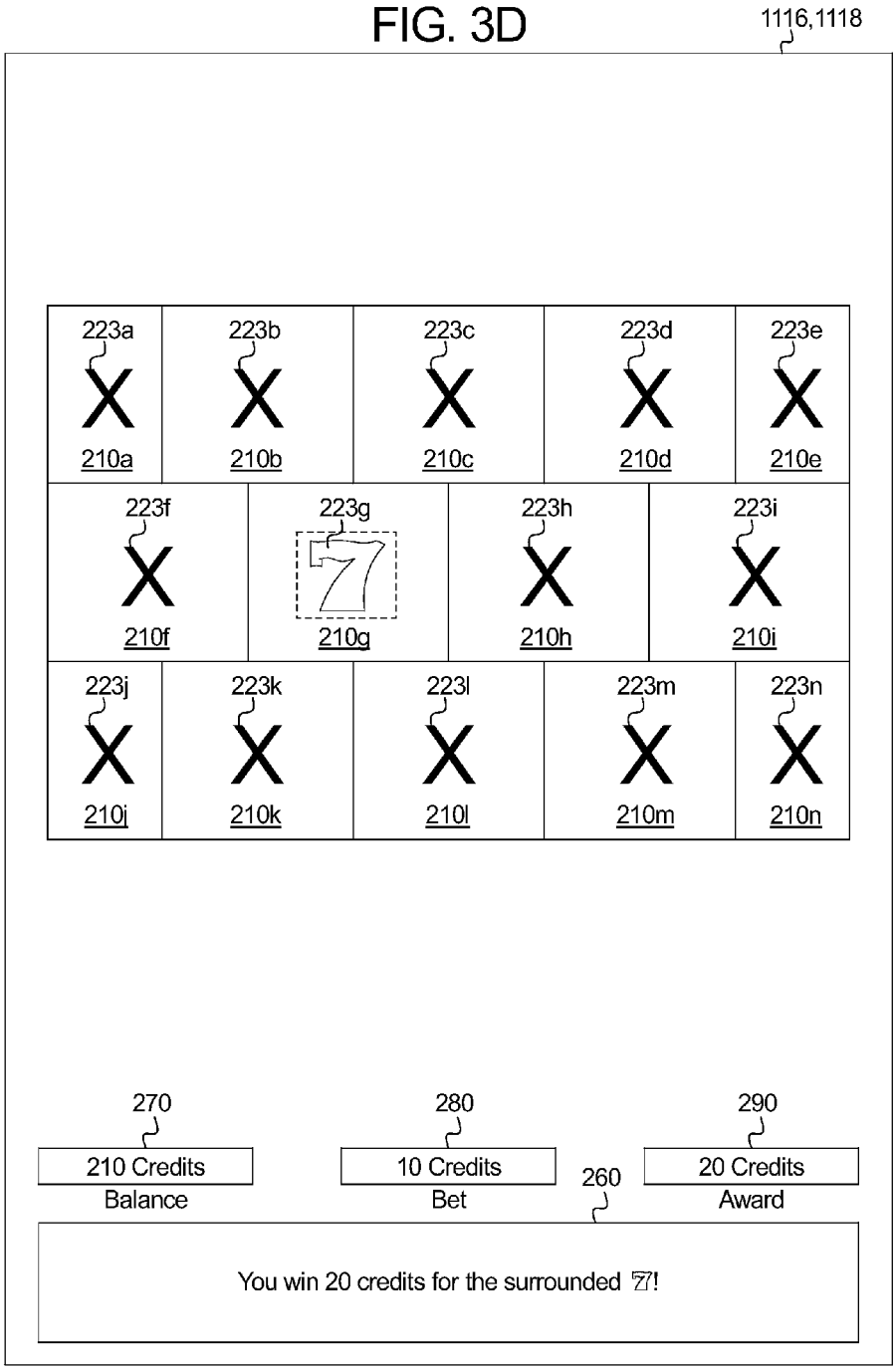

FIG. 3D illustrates a screenshot of an outcome of a play of another example embodiment of the slot game of the present disclosure implemented as a primary wagering game. In this example embodiment, the gaming system determines that a displayed non-enclosing symbol is surrounded by a plurality of displayed enclosing symbols when a continuous or unbroken chain of adjacent symbol display areas that each display an enclosing symbol surrounds the symbol display area of the displayed non-enclosing symbol.

In this example embodiment, the slot game is associated with the plurality of different symbols described above with respect to FIG. 3A. The gaming system displays a plurality of symbol display areas including symbol display areas 210*a*, 210*b*, 210*c*, 210*d*, 210*e*, 210*f*, 210*g*, 210*h*, 210*i*, 210*j*, 210*k*, 210*l*, 210*m*, and 210*n*. Each of the symbol display areas is configured to display one of the symbols.

As noted above, the gaming system displays an outcome of a play of the slot game of this example embodiment. In this instance, the gaming system displays: (a) enclosing X symbol 223*a* at the symbol display area 210*a*, (b) enclosing X symbol 223*b* at the symbol display area 210*b*, (c) enclosing X symbol 223*c* at the symbol display area 210*c*, (d) enclosing X symbol 223*d* at the symbol display area 210*d*, (e) enclosing X symbol 223*e* at the symbol display area 210*e*, (f) enclosing X symbol 223*f* at the symbol display area 210*f*, (g) non-enclosing Seven symbol 223*g* at the symbol display area 210*g*, (h) enclosing X symbol 223*h* at the symbol display area 210*h*, (i) enclosing X symbol 223*i* at the symbol display area 210*i*, (j) enclosing X symbol 223*j* at the symbol display area 210*j*, (k) enclosing X symbol 223*k* at the symbol display area 210*k*, (l) enclosing X symbol 2231 at the symbol display area 2101, (m) enclosing X symbol 223*m* at the symbol display area 210*m*, and (n) enclosing X symbol 223*n* at the symbol display area 210*n*.

The gaming system determines whether any displayed non-enclosing symbols are surrounded by a plurality of displayed enclosing symbols as described above. Here, the gaming system determines that the non-enclosing Seven symbol 223*g* is surrounded by a plurality of enclosing X symbols 223*b*, 223*c*, 223*h*, 223*l*, 223*k*, and 223*f* because the respective symbol display areas 210*b*, 210*c*, 210*h*, 210*l*, 210*k*, and 210*f* of those enclosing X symbols form a continuous chain of adjacent symbol display areas that surround the symbol display area 210*g* of the non-enclosing Seven symbol 223*g*.

The gaming system determines any awards associated with the surrounded non-enclosing symbols (if any) as described above with respect to FIG. 3A. Here, the gaming system determines an award of 20 credits associated the single surrounded non-enclosing Seven symbol 223*g*, and displays the determined 20 credit total award in the award meter 290. The gaming system displays the following message in the message box 260: "YOU WIN 20 CREDITS FOR THE SURROUNDED 7!"

Figure 3E:
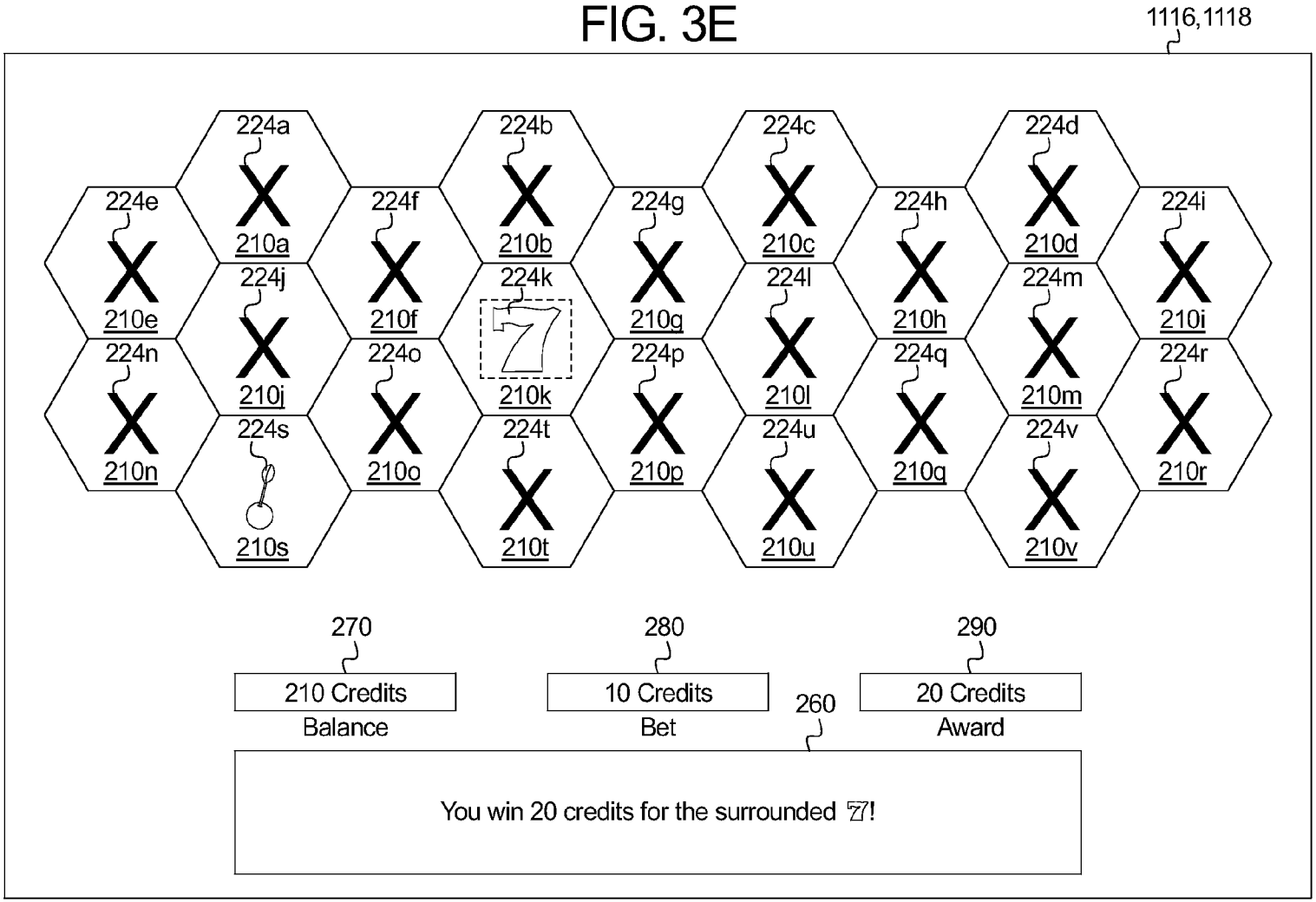

FIG. 3E illustrates a screenshot of an outcome of a play of another example embodiment of the slot game of the present disclosure implemented as a primary wagering game. In this example embodiment, the gaming system determines that a displayed non-enclosing symbol is surrounded by a plurality of displayed enclosing symbols when a continuous or unbroken chain of adjacent symbol display areas that each display an enclosing symbol surrounds the symbol display area of the displayed non-enclosing symbol.

In this example embodiment, the slot game is associated with the plurality of different symbols described above with respect to FIG. 3A. The gaming system displays a plurality of symbol display areas including symbol display areas 210*a*, 210*b*, 210*c*, 210*d*, 210*e*, 210*f*, 210*g*, 210*h*, 210*i*, 210*j*, 210*k*, 210*l*, 210*m*, 210*n*, 2100, 210*p*, 210*q*, 210*r*, 210*s*, 210*t*, 210*u*, and 210*v*. Each of the symbol display areas is configured to display one of the symbols.

As noted above, the gaming system displays an outcome of a play of the slot game of this example embodiment. In this instance, the gaming system displays: (a) enclosing X symbol 224*a* at the symbol display area 210*a*, (b) enclosing X symbol 224*b* at the symbol display area 210*b*, (c) enclosing X symbol 224*c* at the symbol display area 210*c*, (d) enclosing X symbol 224*d* at the symbol display area 210*d*, (e) enclosing X symbol 224*e* at the symbol display area 210*e*, (f) enclosing X symbol 224*f* at the symbol display area 210*f*, (g) enclosing X symbol 224*g* at the symbol display area 210*g*, (h) enclosing X symbol 224*h* at the symbol display area 210*h*, (i) enclosing X symbol

224*i* at the symbol display area 210*i*, (j) enclosing X symbol 224*j* at the symbol display area 210*j*, (k) non-enclosing Seven symbol 224*k* at the symbol display area 210*k*, (l) enclosing X symbol 2241 at the symbol display area 2101, (m) enclosing X symbol 224*m* at the symbol display area 210*m*, (n) enclosing X symbol 224*n* at the symbol display area 210*n*, (o) enclosing X symbol 224*o* at the symbol display area 2100, (p) enclosing X symbol 224*p* at the symbol display area 210*p*, (q) enclosing X symbol 224*q* at the symbol display area 210*q*, (r) enclosing X symbol 224*r* at the symbol display area 210*r*, (s) non-enclosing Cherry symbol 224*s* at the symbol display area 210*s*, (t) enclosing X symbol 224*t* at the symbol display area 210*t*, (u) enclosing X symbol 224*u* at the symbol display area 210*u*, and (v) enclosing X symbol 224*v* at the symbol display area 210*v*.

The gaming system determines whether any displayed non-enclosing symbols are surrounded by a plurality of displayed enclosing symbols as described above. Here, the gaming system determines that the non-enclosing Seven symbol 224*k* is surrounded by a plurality of enclosing X symbols 224*b*, 224*g*, 224*p*, 224*t*, 224*o*, and 224*f*, because the respective symbol display areas 210*b*, 210*g*, 210*p*, 210*t*, 210*o*, and 210*f* of those enclosing X symbols form a continuous chain of adjacent symbol display areas that surround the symbol display area 210*k* of the non-enclosing Seven symbol 224*k*.

On the other hand, the gaming system determines that the non-enclosing Cherry symbol 224*s* is not surrounded by a plurality of displayed enclosing X symbols because no continuous chain of adjacent symbol display areas displaying enclosing X symbols surrounds the symbol display area 210*s* of the non-enclosing Cherry symbol 224*s*. Rather, a plurality of enclosing X symbols 224*n*, 224*j*, and 224*o* partially surround the non-enclosing Cherry symbol 224*s* because the respective symbol display areas 210*n*, 210*j*, and 210*o* of those enclosing X symbols form a non-continuous chain of adjacent symbol display areas that partially surrounds the symbol display area 210*s* of the non-enclosing Cherry symbol 210*s*.

The gaming system determines any awards associated with the surrounded non-enclosing symbols (if any) as described above with respect to FIG. 3A. Here, the gaming system determines an award of 20 credits associated the single surrounded non-enclosing Seven symbol 224*k*, and displays the determined 20 credit total award in the award meter 290. The gaming system displays the following message in the message box 260: "YOU WIN 20 CREDITS FOR THE SURROUNDED 7!"

Figure 4A:
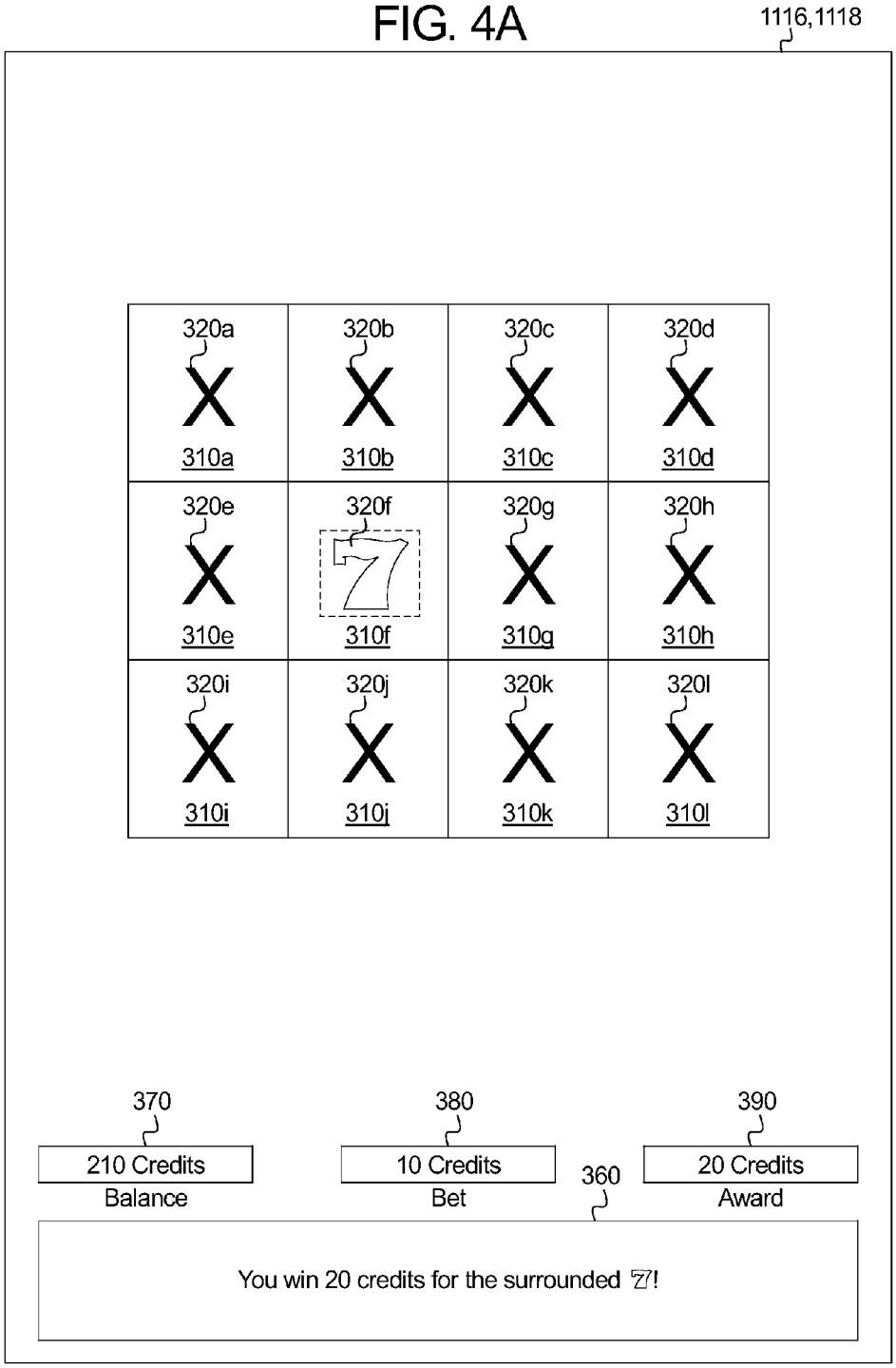
FIGS. 4A, 4B, and 4C illustrate screenshots of different outcomes of plays of another example embodiment of the slot game employing the surrounded symbol award evaluation of the present disclosure.
Figure 4B:
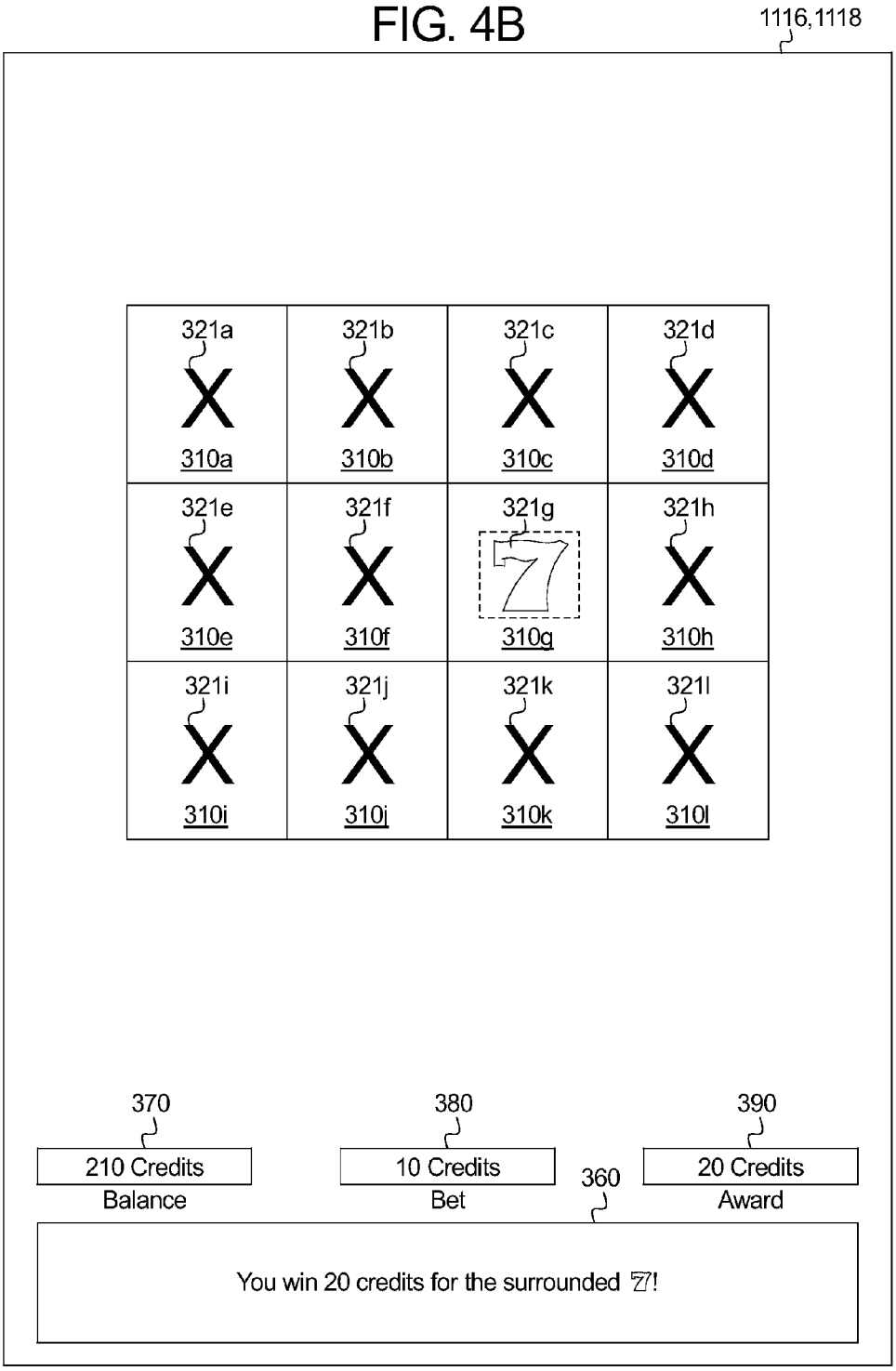
Figure 4C:
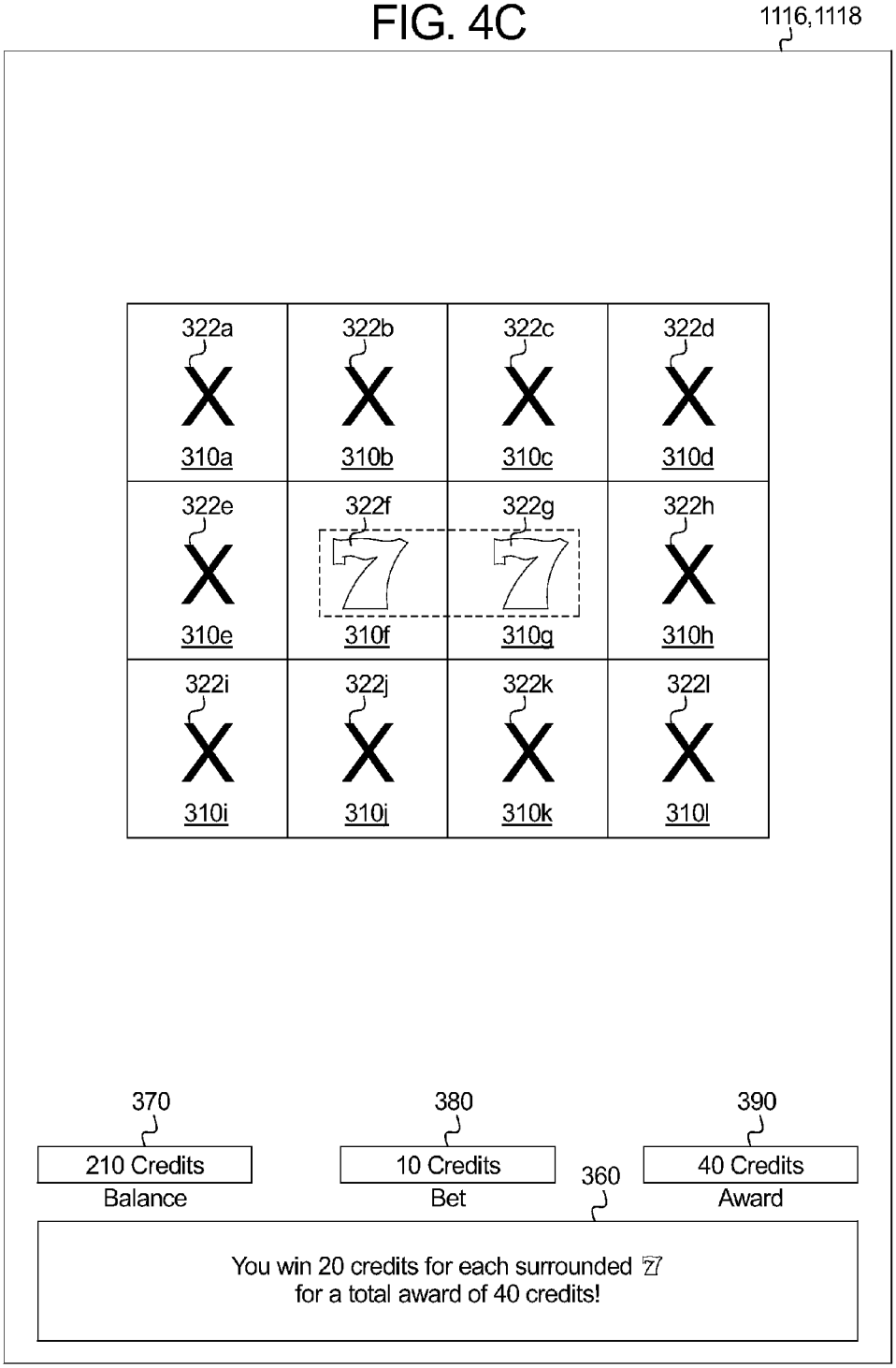

FIGS. 4A, 4B, and 4C illustrate screenshots of different outcomes of plays of another example embodiment of the slot game of the present disclosure implemented as a primary wagering game. In this example embodiment, the gaming system determines that a displayed non-enclosing symbol is surrounded by a plurality of displayed enclosing symbols when a continuous or unbroken chain of adjacent symbol display areas that each display an enclosing symbol surrounds the symbol display area of the displayed non-enclosing symbol.

In this example embodiment, the slot game is associated with the plurality of different symbols described above with respect to FIG. 3A, and the gaming system displays a plurality of symbol display areas including symbol display areas 310*a*, 310*b*, 310*c*, 310*d*, 310*e*, 310*f*, 310*g*, 310*h*, 310*i*, 310*j*, 310*k*, and 310*l* arranged in a 3×4 grid or matrix. Each of the symbol display areas is configured to display one of the symbols. The gaming system also displays: (a) a message box 360 (described above); and (b) a plurality of meters including: (i) a credit meter 370 (described above), (ii) a wager or bet meter 380 (described above), and (iii) an award meter 390 (described above).

Turning to FIG. 4A, the gaming system displays an outcome of a play of the slot game of this example embodiment. In this instance, the gaming system displays: (a) enclosing X symbol 320*a* at the symbol display area 310*a*, (b) enclosing X symbol 320*b* at the symbol display area 310*b*, (c) enclosing X symbol 320*c* at the symbol display area 310*c*, (d) enclosing X symbol 320*d* at the symbol display area 310*d*, (e) enclosing X symbol 320*e* at the symbol display area 310*e*, (f) non-enclosing Seven symbol 320*f* at the symbol display area 310*f*, (g) enclosing X symbol 320*g* at the symbol display area 310*g*, (h) enclosing X symbol 320*h* at the symbol display area 310*h*, (i) enclosing X symbol 320*i* at the symbol display area 310*i*, (j) enclosing X symbol 320*j* at the symbol display area 310*j*, (k) enclosing X symbol 320*k* at the symbol display area 310*k*, and (l) enclosing X symbol 320*l* at the symbol display area 310*l*.

The gaming system determines whether any displayed non-enclosing symbols are surrounded by a plurality of displayed enclosing symbols as described above. Here, the gaming system determines that the non-enclosing Seven symbol 320*f* is surrounded by a plurality of enclosing X symbols 320*a*, 320*b*, 320*c*, 320*g*, 320*k*, 320*j*, 320*i*, and 320*e* because the respective symbol display areas 310*a*, 310*b*, 310*c*, 310*g*, 310*k*, 310*j*, 310*i*, and 310*e* of those enclosing X symbols form a continuous chain of adjacent symbol display areas that surround the symbol display area 310*f* of the non-enclosing Seven symbol 320*f*.

The gaming system determines any awards associated with the surrounded non-enclosing symbols (if any) as described above with respect to FIG. 3A. Here, the gaming system determines an award of 20 credits associated with the single surrounded non-enclosing Seven symbol 320*f*, and displays the determined 20 credit total award in the award meter 390. The gaming system displays the following message in the message box 360: "YOU WIN 20 CREDITS FOR THE SURROUNDED 7!"

Turning to FIG. 4B, the gaming system displays an outcome of another play of the slot game of this example embodiment. In this instance, the gaming system displays: (a) enclosing X symbol 321*a* at the symbol display area 310*a*, (b) enclosing X symbol 321*b* at the symbol display area 310*b*, (c) enclosing X symbol 321*c* at the symbol display area 310*c*, (d) enclosing X symbol 321*d* at the symbol display area 310*d*, (e) enclosing X symbol 321*e* at the symbol display area 310*e*, (f) enclosing X symbol 321*f* at the symbol display area 310*f*, (g) non-enclosing Seven symbol 321*g* at the symbol display area 310*g*, (h) enclosing X symbol 321*h* at the symbol display area 310*h*, (i) enclosing X symbol 321*i* at the symbol display area 310*i*, (j) enclosing X symbol 321*j* at the symbol display area 310*j*, (k) enclosing X symbol 321*k* at the symbol display area 310*k*, and (l) enclosing X symbol 3211 at the symbol display area 3101.

The gaming system determines whether any displayed non-enclosing symbols are surrounded by a plurality of displayed enclosing symbols as described above. Here, the gaming system determines that the non-enclosing Seven symbol 321*g* is surrounded by a plurality of enclosing X symbols 321*b*, 321*c*, 321*d*, 321*h*, 321*l*, 321*k*, 321*j*, and 321*f* because the respective symbol display areas 310*b*, 310*c*, 310*d*, 310*h*, 310*l*, 310*k*, 310*j*, and 310*f* of those enclosing X symbols form a continuous chain of adjacent symbol display areas that surround the symbol display area 310*g* of the non-enclosing Seven symbol 321*g*.

The gaming system determines any awards associated with the surrounded non-enclosing symbols (if any) as described above with respect to FIG. 3A. Here, the gaming system determines an award of 20 credits associated with the single surrounded non-enclosing Seven symbol 321*g*, and displays the determined 20 credit total award in the award meter 390. The gaming system displays the following message in the message box 360: "YOU WIN 20 CREDITS FOR THE SURROUNDED 7!"

Turning to FIG. 4C, the gaming system displays an outcome of another play of the slot game of this example embodiment. In this instance, the gaming system displays: (a) enclosing X symbol 322*a* at the symbol display area 310*a*, (b) enclosing X symbol 322*b* at the symbol display area 310*b*, (c) enclosing X symbol 322*c* at the symbol display area 310*c*, (d) enclosing X symbol 322*d* at the symbol display area 310*d*, (e) enclosing X symbol 322*e* at the symbol display area 310*e*, (f) non-enclosing Seven symbol 322*f* at the symbol display area 310*f*, (g) non-enclosing Seven symbol 322*g* at the symbol display area 310*g*, (h) enclosing X symbol 322*h* at the symbol display area 310*h*, (i) enclosing X symbol 322*i* at the symbol display area 310*i*, (j) enclosing X symbol 322*j* at the symbol display area 310*j*, (k) enclosing X symbol 322*k* at the symbol display area 310*k*, and (l) enclosing X symbol 322*l* at the symbol display area 310*l*.

The gaming system determines whether any displayed non-enclosing symbols are surrounded by a plurality of displayed enclosing symbols as described above. Here, the gaming system determines that the non-enclosing Seven symbols 322*f* and 322*g* are surrounded by a plurality of enclosing X symbols 322*a*, 322*b*, 322*c*, 322*d*, 322*h*, 322*l*, 322*k*, 322*j*, 322*i*, and 322*e* because the respective symbol display areas 310*a*, 310*b*, 310*c*, 310*d*, 310*h*, 310*l*, 310*k*, 310*j*, 310*i*, and 310*e* of those enclosing X symbols form a continuous chain of adjacent symbol display areas that surround the symbol display areas 310*f* and 310*g* of the non-enclosing Seven symbols 322*f* and 322*g*.

The gaming system determines any awards associated with the surrounded non-enclosing symbols (if any) as described above with respect to FIG. 3A. Here, the gaming system determines an award of 20 credits associated each of the surrounded non-enclosing Seven symbols 322*f* and 322*g*, and displays the determined 40 credit total award in the award meter 390. The gaming system displays the following message in the message box 360: "YOU WIN 20 CREDITS FOR EACH SURROUNDED 7 FOR A TOTAL AWARD OF 40 CREDITS!"

Figure 5:
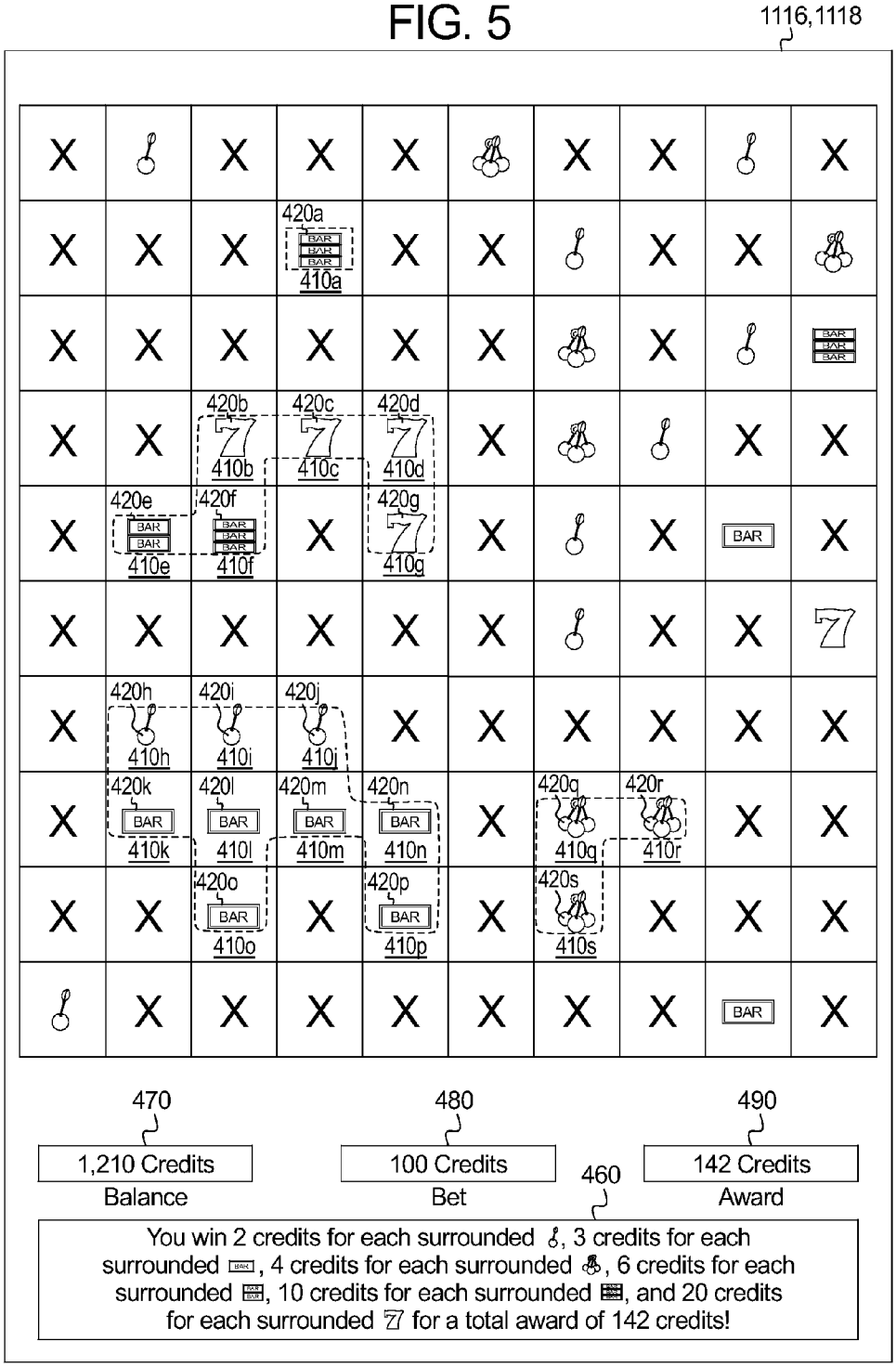
FIG. 5 illustrates a screenshot of an outcome of a play of another example embodiment of the slot game of the present disclosure employing the surrounded symbol award evaluation.

FIG. 5 illustrates a screenshot of an outcome of a play of another example embodiment of the slot game of the present disclosure implemented as a primary wagering game. In this example embodiment, the gaming system determines that a displayed non-enclosing symbol is surrounded by a plurality of displayed enclosing symbols when a continuous or unbroken chain of adjacent symbol display areas that each display an enclosing symbol surrounds the symbol display area of the displayed non-enclosing symbol.

In this example embodiment, the slot game is associated with the plurality of different symbols described above with respect to FIG. 3A, and the gaming system displays a plurality of symbol display areas (not all of which are labeled or listed for clarity and brevity) arranged in a 10×10 grid or matrix. Each of the symbol display areas is configured to display one of the symbols. The gaming system also displays: (a) a message box 460 (described above); and (b) a plurality of meters including: (i) a credit meter 470 (described above), (ii) a wager or bet meter 480 (described above)), and (iii) an award meter 490 (described above).

As noted above, the gaming system displays an outcome of a play of the slot game of this example embodiment. In this instance, the gaming system displays, in pertinent part: (a) non-enclosing Triple Bar symbol 420*a* at symbol display area 410*a*, (b) non-enclosing Seven symbol 420*b* at symbol display area 410*b*, (c) non-enclosing Seven symbol 420*c* at symbol display area 410*c*, (d) non-enclosing Seven symbol 420*d* at symbol display area 410*d*, (e) non-enclosing Double Bar symbol 420*e* at symbol display area 410*e*, (f) non-enclosing Triple Bar symbol 420*f* at symbol display area 410*f*, (g) non-enclosing Seven symbol 420*g* at symbol display area 410*g*, (h) non-enclosing Cherry symbol 420*h* at symbol display area 410*h*, (i) non-enclosing Cherry symbol 420*i* at symbol display area 410*i*, (j) non-enclosing Cherry symbol 420*j* at symbol display area 410*j*, (k) non-enclosing Bar symbol 420*k* at symbol display area 410*k*, (l) non-enclosing Bar symbol 4201 at symbol display area 4101, (m) non-enclosing Bar symbol 420*m* at symbol display area 410*m*, (n) non-enclosing bar symbol 420*n* at symbol display area 410*n*, (o) non-enclosing Bar symbol 420*o* at symbol display area 410*o*, (p) non-enclosing Bar symbol 420*p* at symbol display area 410*p*, (q) non-enclosing Triple Cherry symbol 420*q* at symbol display area 410*q*, (r) non-enclosing Triple Cherry symbol 420*r* at symbol display area 410*r*, and (s) non-enclosing Triple Cherry symbol 420*s* at symbol display area 410*s*.

The gaming system determines whether any displayed non-enclosing symbols are surrounded (i.e., enclosed) by a plurality of displayed enclosing symbols as described above. Here, the gaming system determines that: (a) the non-enclosing Triple Bar symbol 420*a* is surrounded by a first plurality of enclosing X symbols because the respective symbol display areas of those enclosing X symbols form a continuous chain of adjacent symbol display areas that surround the symbol display area of that non-enclosing symbol; (b) the non-enclosing Seven symbols 420*b*, 420*c*, 420*d*, and 420*g*; the non-enclosing Double Bar symbol 420*e*; and the non-enclosing Triple Bar symbol 420*f* are surrounded by a second different plurality of enclosing X symbols because the respective symbol display areas of those enclosing X symbols form a continuous chain of adjacent symbol display areas that surround the symbol display areas of those non-enclosing symbols; (c) the non-enclosing Cherry symbols 420*h*, 420*i*, and 420*j* and the non-enclosing Bar symbols 420*k*, 420*l*, 420*m*, 420*n*, 420*o*, and 420*p* are surrounded by a third different plurality of enclosing X symbols because the respective symbol display areas of those enclosing X symbols form a continuous chain of adjacent symbol display areas that surround the symbol display areas of those non-enclosing symbols; and (d) the non-enclosing Triple Cherry symbols 420*q*, 420*r*, and 420*s* are surrounded by a fourth different plurality of enclosing X symbols because the respective symbol display areas of those enclosing X symbols form a continuous chain of adjacent symbol display areas that surround the symbol display areas of those non-enclosing symbols.

The gaming system determines any awards associated with the surrounded non-enclosing symbols (if any) as described above with respect to FIG. 3A. Here, the gaming system determines a total award of 142 credits associated with the surrounded non-enclosing symbols 420*a*, 420*b*, 420*c*, 420*d*, 420*e*, 420*f*, 420*g*, 420*h*, 420*i*, 420*j*, 420*k*, 420*l*, 420*m*, 420*n*, 420*o*, 420*p*, 420*q*, 420*r*, and 420*s*, and displays the determined 142 credit total award in the award meter 490. The gaming system displays the following message in the message box 460: "YOU WIN 2 CREDITS FOR EACH SURROUNDED CHERRY, 3 CREDITS FOR EACH SURROUNDED BAR, 4 CREDITS FOR EACH SURROUNDED TRIPLE CHERRY, 6 CREDITS FOR EACH SURROUNDED DOUBLE BAR, 10 CREDITS FOR EACH SURROUNDED TRIPLE BAR, AND 20 CREDITS FOR EACH SURROUNDED SEVEN FOR A TOTAL AWARD OF 142 CREDITS!!"

Figure 6:
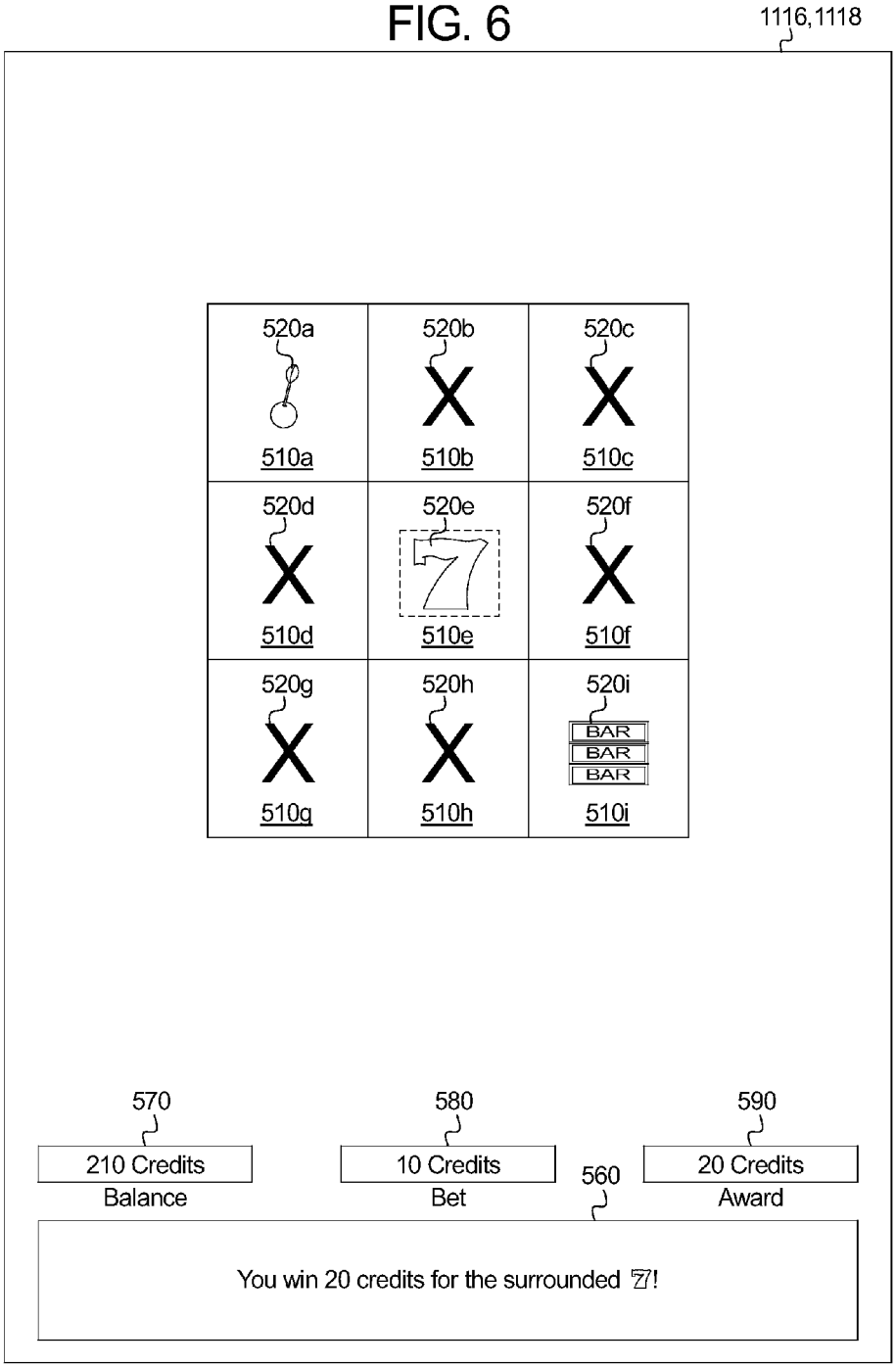
FIG. 6 illustrates a screenshot of an outcome of a play of another example embodiment of the slot game of the present disclosure employing the surrounded symbol award evaluation.

FIG. 6 illustrates a screenshot of an outcome of a play of another example embodiment of the slot game of the present disclosure implemented as a primary wagering game. In this example embodiment, the gaming system determines that a displayed non-enclosing symbol is surrounded by a plurality of displayed enclosing symbols when: (a) the symbol display area of the displayed non-enclosing symbol is, on all sides, orthogonally adjacent to another symbol display area; and (b) an enclosing symbol is displayed at each such symbol display area orthogonally adjacent to the symbol display area of the displayed non-enclosing symbol.

In this example embodiment, the slot game is associated with the plurality of different symbols described above with respect to FIG. 3A, and the gaming system displays a plurality of symbol display areas including symbol display areas 510*a*, 510*b*, 510*c*, 510*d*, 510*e*, 510*f*, 510*g*, 510*h*, and 510*i* arranged in a 3×3 grid or matrix. Each of the symbol display areas is configured to display one of the symbols. The gaming system also displays: (a) a message box 560 (described above); and (b) a plurality of meters including: (i) a credit meter 570 (described above), (ii) a wager or bet meter 580 (described above), and (iii) an award meter 590 (described above).

As noted above, the gaming system displays an outcome of a play of the slot game of this example embodiment. In this instance, the gaming system displays: (a) non-enclosing Cherry symbol 520*a* at the symbol display area 510*a*, (b) enclosing X symbol 520*b* at the symbol display area 510*b*, (c) enclosing X symbol 520*c* at the symbol display area 510*c*, (d) enclosing X symbol 520*d* at the symbol display area 510*d*, (e) non-enclosing Seven symbol 520*e* at the symbol display area 510*e*, (f) enclosing X symbol 520*f* at the symbol display area 510*f*, (g) enclosing X symbol 520*g* at the symbol display area 510*g*, (h) enclosing X symbol 520*h* at the symbol display area 510*h*, and (i) non-enclosing Triple Bar symbol 520*i* at the symbol display area 510*i*.

The gaming system determines whether any displayed non-enclosing symbols are surrounded by a plurality of displayed enclosing symbols as described above. Here, the gaming system determines that the non-enclosing Seven symbol 520*e* is surrounded by a plurality of enclosing X symbols 520*b*, 520*d*, 520*f*, and 520*h* because: (a) the symbol display area 521*e* of the non-enclosing Seven symbol 520*e* is, on all sides, orthogonally adjacent to another symbol display area; and (b) those orthogonally adjacent symbol display areas 510*b*, 510*d*, 510*f*, and 510*h* display the enclosing X symbols. On the other hand: (a) because there are no symbol display areas above or to the left of the symbol display area 510*a*, the gaming system determines that the non-enclosing Cherry symbol 520*a* is not surrounded by a plurality of displayed enclosing symbols; and (b) because there are no symbol display areas below or to the right of the symbol display area 510*i*, the gaming system determines that the non-enclosing Triple Bar symbol 520*i* is not surrounded by a plurality of displayed enclosing symbols.

The gaming system determines any awards associated with the surrounded non-enclosing symbols (if any) as described above with respect to FIG. 3A. Here, the gaming system determines an award of 20 credits associated with the single surrounded non-enclosing Seven symbol 520*e*, and displays the determined 20 credit total award in the award meter 590. The gaming system displays the following message in the message box 560: "YOU WIN 20 CREDITS FOR THE SURROUNDED 7!"

In various embodiments, the plurality of symbols employed for the slot game includes: (a) a plurality of enclosing symbols of a first type, (b) a plurality of enclosing symbols of a second type, and (c) a plurality of non-enclosing symbols. In certain such embodiments, the gaming system determines that a displayed non-enclosing symbol is surrounded by a plurality of displayed enclosing symbols when a continuous or unbroken chain of adjacent symbol display areas that each display a same type of enclosing symbol surrounds the symbol display area of the displayed non-enclosing symbol.

Figure 7A:
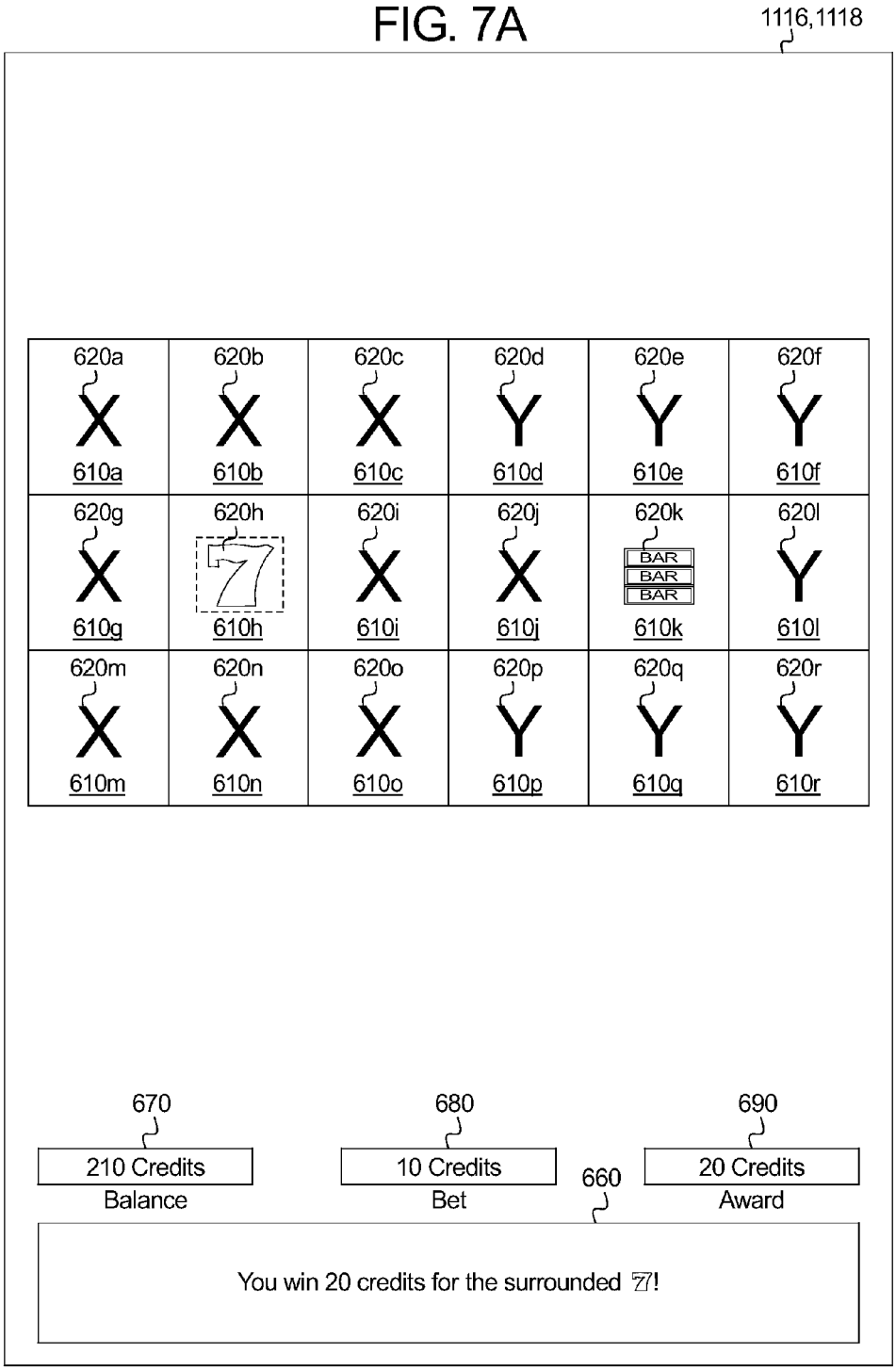
FIGS. 7A and 7B illustrate screenshots of different outcomes of plays of other example embodiments of the slot game of the present disclosure employing the surrounded symbol award evaluation.

FIG. 7A illustrates a screenshot of an outcome of a play of one such example embodiment of the slot game of the present disclosure implemented as a primary wagering game in which: (a) the slot game is associated with a plurality of different symbols including: (i) a plurality of enclosing X symbols (i.e., enclosing symbols of a first type); (ii) a plurality of enclosing Y symbols (i.e., enclosing symbols of a second type); and (iii) a plurality of non-enclosing symbols including the non-enclosing Cherry symbol, the non-enclosing Bar symbol, the non-enclosing Triple Cherry symbol, the non-enclosing Double Bar symbol, the non-enclosing Triple Bar symbol, and the non-enclosing Seven symbol; and (b) the gaming system determines that a displayed non-enclosing symbol is surrounded by a plurality of displayed enclosing symbols when a continuous or unbroken chain of adjacent symbol display areas that each display a same type of enclosing symbol surrounds the symbol display area of the displayed non-enclosing symbol.

In this example embodiment, the gaming system displays a plurality of symbol display areas including symbol display areas 610*a*, 610*b*, 610*c*, 610*d*, 610*e*, 610*f*, 610*g*, 610*h*, 610*i*, 610*j*, 610*k*, 610*l*, 610*m*, 610*n*, 610*o*, 610*p*, 610*q*, and 610*r* arranged in a 3×6 grid or matrix. Each of the symbol display areas is configured to display one of the symbols. The gaming system also displays: (a) a message box 660 (described above); and (b) a plurality of meters including: (i) a credit meter 670 (described above), (ii) a wager or bet meter 680 (described above), and (iii) an award meter 680 (described above).

As noted above, the gaming system displays an outcome of a play of the slot game of this example embodiment. In this instance, the gaming system displays: (a) enclosing X symbol 620*a* at the symbol display area 610*a*, (b) enclosing X symbol 620*b* at the symbol display area 610*b*, (c) enclosing X symbol 620*c* at the symbol display area 610*c*, (d) enclosing Y symbol 620*d* at the symbol display area 610*d*, (e) enclosing Y symbol 620*e* at the symbol display area 610*e*, (f) enclosing Y symbol 620*f* at the symbol display area 610*f*, (g) enclosing X symbol 620*g* at the symbol display area 610*g*, (h) non-enclosing Seven symbol 620*h* at the symbol display area 610*h*, (i) enclosing X symbol 620*i* at the symbol display area 610*i*, (j) enclosing X symbol 620*j* at the symbol display area 610*j*, (k) non-enclosing Triple Bar symbol 620*k* at the symbol display area 610*k*, (l) enclosing Y symbol 6201 at the symbol display area 6101, (m) enclosing X symbol 620*m* at the symbol display area 610*m*, (n) enclosing X symbol 620*n* at the symbol display area 610*n*, (o) enclosing X symbol 620*o* at the symbol display area 6100, (p) enclosing Y symbol 620*p* at the symbol display area 610*p*, (q) enclosing Y symbol 620*q* at the symbol display area 610*q*, and (r) enclosing Y symbol 620*r* at the symbol display area 610*r*.

The gaming system determines whether any displayed non-enclosing symbols are surrounded by a plurality of displayed enclosing symbols as described above. Here, the gaming system determines that the non-enclosing Seven symbol 620*h* is surrounded by a plurality of enclosing X symbols

620*a*, 620*b*, 620*c*, 620*i*, 620*o*, 620*n*, 620*m*, and 620*g* because the respective symbol display areas 610*a*, 610*b*, 610*c*, 610*i*, 610*o*, 610*n*, 610*m*, and 610*g* of those enclosing X symbols (i.e., enclosing symbols of the same type) form a continuous chain of adjacent symbol display areas that surround the symbol display area 610*h* of the non-enclosing Seven symbol 620*h*. On the other hand, the gaming system determines that the non-enclosing Triple Bar symbol 620*k* is not surrounded by a plurality of displayed enclosing symbols because no continuous chain of adjacent symbol display areas displaying enclosing symbols of the same type surrounds the symbol display area 610*k* of the non-enclosing Triple Bar symbol 620*k*. Rather, a plurality of enclosing Y symbols 620*d*, 620*e*, 620*f*, 620*l*, 620*r*, 620*q*, and 620*p* partially surround the non-enclosing Triple Bar symbol 620*k* because the respective symbol display areas 610*d*, 610*e*, 610*f*, 610*l*, 610*r*, 610*q*, and 610*p* of those enclosing Y symbols form a non-continuous chain of adjacent symbol display areas that partially surrounds the symbol display area 610*k* of the non-enclosing Triple Bar symbol 610*k*.

The gaming system determines any awards associated with the surrounded non-enclosing symbols (if any) as described above with respect to FIG. 3A. Here, the gaming system determines an award of 20 credits associated with the single surrounded non-enclosing Seven symbol 620*h*, and displays the determined 20 credit total award in the award meter 690. The gaming system displays the following message in the message box 660: "YOU WIN 20 CREDITS FOR THE SURROUNDED 7!"

In other such embodiments, the gaming system determines that a displayed non-enclosing symbol is surrounded by a plurality of displayed enclosing symbols when a continuous or unbroken chain of adjacent symbol display areas that each display an enclosing symbol of any type surrounds the symbol display area of the displayed non-enclosing symbol.

Figure 7B:
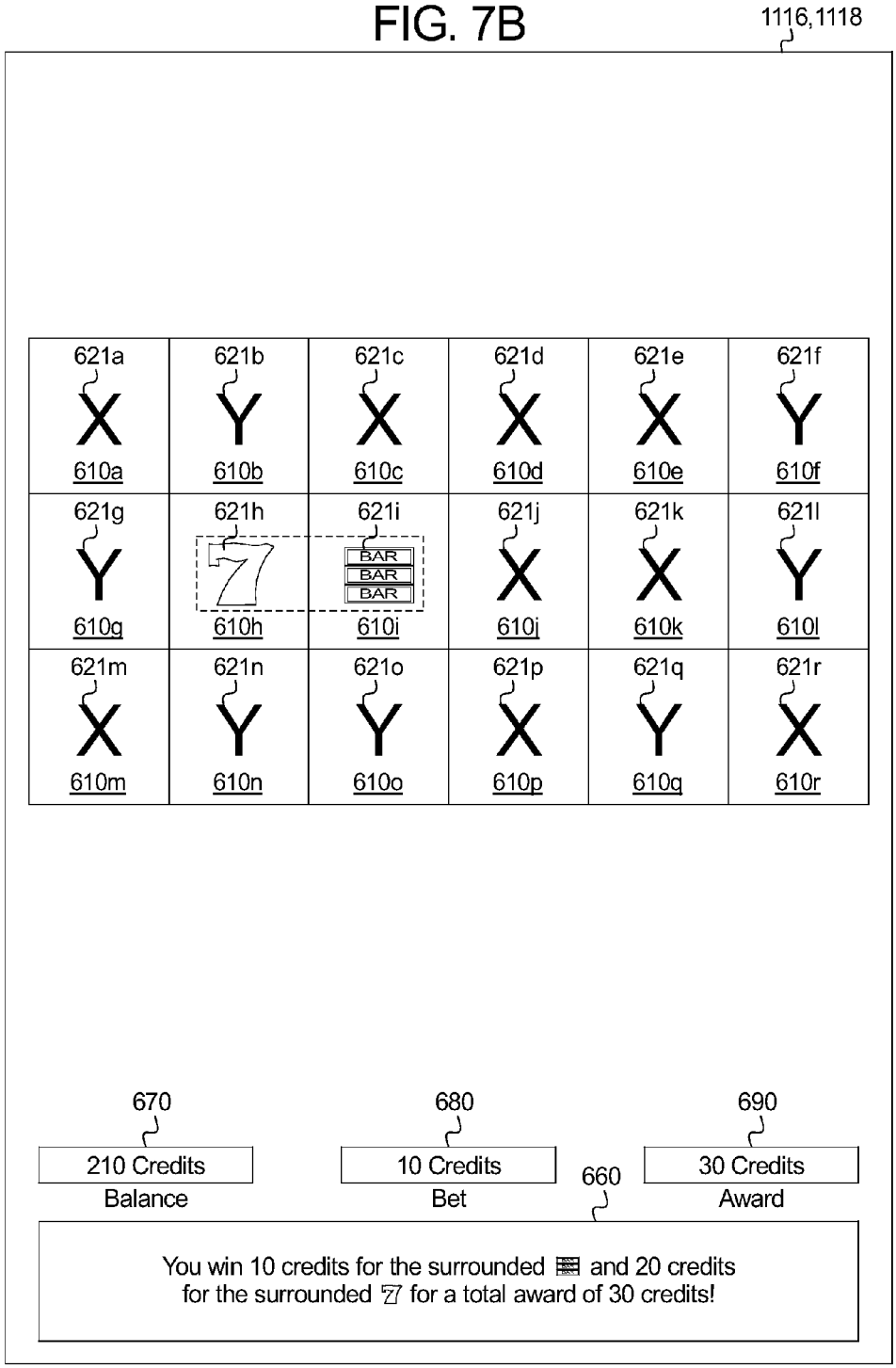

FIG. 7B illustrates a screenshot of an outcome of a play of one such example embodiment of the slot game of the present disclosure implemented as a primary wagering game in which: (a) the slot game is associated with the plurality of different symbols described above with respect to FIG. 7A, and (b) the gaming system determines that a displayed non-enclosing symbol is surrounded by a plurality of displayed enclosing symbols when a continuous or unbroken chain of adjacent symbol display areas that each display an enclosing symbol of any type surrounds the symbol display area of the displayed non-enclosing symbol.

As noted above, the gaming system displays an outcome of a play of the slot game of this example embodiment. In this instance, the gaming system displays: (a) enclosing X symbol 621*a* at the symbol display area 610*a*, (b) enclosing Y symbol 621*b* at the symbol display area 610*b*, (c) enclosing X symbol 621*c* at the symbol display area 610*c*, (d) enclosing X symbol 621*d* at the symbol display area 610*d*, (e) enclosing X symbol 621*e* at the symbol display area 610*e*, (f) enclosing Y symbol 621*f* at the symbol display area 610*f*, (g) enclosing Y symbol 621*g* at the symbol display area 610*g*, (h) non-enclosing Seven symbol 621*h* at the symbol display area 610*h*, (i) non-enclosing Triple Bar symbol 621*i* at the symbol display area 610*i*, (j) enclosing X symbol 621*j* at the symbol display area 610*j*, (k) enclosing X symbol 621*k* at the symbol display area 610*k*, (l) enclosing Y symbol 6211 at the symbol display area 6101, (m) enclosing X symbol 621*m* at the symbol display area 610*m*, (n) enclosing Y symbol 621*n* at the symbol display area 610*n*, (o) enclosing Y symbol 6210 at the symbol display area 6100, (p) enclosing X symbol 621*p* at the symbol display area 610*p*, (q) enclosing Y symbol 621*q* at the symbol display area 610*q*, and (r) the enclosing X symbol 621*r* at the symbol display area 610*r*.

The gaming system determines whether any displayed non-enclosing symbols are surrounded by a plurality of displayed enclosing symbols as described above. Here, the gaming system determines that the non-enclosing Seven symbol 621*h* and the non-enclosing Triple Bar symbol 621*i* are surrounded by a plurality of enclosing symbols 621*a*, 621*b*, 621*c*, 621*d*, 621*j*, 621*p*, 621*o*, 621*n*, 621*m*, and 621*g* because the respective symbol display areas 610*a*, 610*b*, 610*c*, 610*d*, 610*j*, 610*p*, 6100, 610*n*, 610*m*, and 610*g* of those enclosing symbols (regardless of whether they are enclosing X or enclosing Y symbols) form a continuous chain of adjacent symbol display areas that surround the symbol display areas 610*h* and 610*i* of the non-enclosing Seven symbol 621*h* and the non-enclosing Triple Bar symbol 621*i*.

The gaming system determines any awards associated with the surrounded non-enclosing symbols (if any) as described above with respect to FIG. 3A. Here, the gaming system determines an award of 20 credits associated with the surrounded non-enclosing Seven symbol 621*h* and an award of 10 credits for the surrounded non-enclosing Triple Bar symbol 6211, and displays the determined 30 credit total award in the award meter 690. The gaming system displays the following message in the message box 660: "YOU WIN 10 CREDITS FOR THE SURROUNDED TRIPLE BAR AND 20 CREDITS FOR THE SURROUNDED 7 FOR A TOTAL AWARD OF 30 CREDITS!"

In certain such embodiments, enclosing symbols of different types are associated with different awards. For instance, in one example embodiment, the gaming system provides: (a) a first award when a displayed non-enclosing symbol is surrounded by a plurality of displayed enclosing symbols of a first type, and (b) a second different award when the displayed non-enclosing symbol is surrounded by a plurality of displayed enclosing symbols of a second different type. In another example, the gaming system provides: (a) a first award when a displayed non-enclosing symbol is surrounded by a plurality of displayed enclosing symbols of a first type, (b) a second different award when the displayed non-enclosing symbol is surrounded by a plurality of displayed enclosing symbols of a second different type, and (c) a third different award when the displayed non-enclosing symbol is surrounded by a plurality of displayed enclosing symbols including at least one displayed enclosing symbol of the first type and at least one displayed enclosing symbol of the second different type. In one instance, the third award is the lowest award and the first award is the highest award, and in another example the third award is the highest award and the first award is the lowest award.

In certain embodiments, the plurality of symbols employed for the slot game includes: (a) a plurality of enclosing symbols of a first type, and (b) a plurality of enclosing symbols of a second type. In these embodiments, the gaming system determines an award if: (a) a displayed enclosing symbol of the first type is surrounded by a plurality of displayed enclosing symbols of the second type, and/or (b) a displayed enclosing symbol of the second type is surrounded by a plurality of displayed enclosing symbols of the first type. In other words, in these embodiments, symbols act as both enclosing symbols and non-enclosing symbols.

FIG. 8 illustrates a screenshot of an outcome of a play of one such example embodiment of the slot game of the present disclosure implemented as a primary wagering game in which: (a) the slot game is associated with a plurality of different symbols including: (i) a first group or set of a plurality of enclosing X, Y, and Z symbols (i.e., enclosing symbols of a first type); and (ii) a second group or set of a plurality of enclosing A, B, and C symbols (i.e., enclosing symbols of a second type); and (b) the gaming system determines: (i) that a displayed enclosing symbol of the first group is surrounded by a plurality of displayed enclosing symbols of the second group when a continuous or unbroken chain of adjacent symbol display areas that each display an enclosing symbol of the second group surrounds the symbol display area of the displayed enclosing symbol of the first group; and (ii) that a displayed enclosing symbol of the second group is surrounded by a plurality of displayed enclosing symbols of the first group when a continuous or unbroken chain of adjacent symbol display areas that each display an enclosing symbol of the first group surrounds the symbol display area of the displayed enclosing symbol of the second group.

In this example embodiment, the gaming system displays a plurality of symbol display areas including symbol display areas 710*a*, 710*b*, 710*c*, 710*d*, 710*e*, 710*f*, 710*g*, 710*h*, 710*i*, 710*j*, 710*k*, 710*l*, 710*m*, 710*n*, 710*o*, 710*p*, 710*q*, 710*r*, 710*s*, 710*t*, 710*u*, 710*v*, 710*w*, 710*x*, 710*y*, 710*z*, 710*aa*, 710*bb*, 710*cc*, 710*dd*, 710*ee*, 710*ff*, 710*gg*, 710*hh*, 710*ii*, 710*jj*, 710*kk*, 710*ll*, 710*mm*, 710*nn*, 710*oo*, 710*pp*, 710*qq*, 710*rr*, 710*ss*, 710*tt*, 710*uu*, 710*vv*, 710*ww*, and 710*xx* arranged in a 5×10 grid or matrix. Each of the symbol display areas is configured to display one of the symbols. The gaming system also displays: (a) a message box 760 (described above); and (b) a plurality of meters including: (i) a credit meter 770 (described above), (ii) a wager or bet meter 780 (described above), and (iii) an award meter 790 (described above).

As noted above, the gaming system displays an outcome of a play of the slot game of this example embodiment (not listed for brevity). The gaming system determines whether any displayed enclosing symbols of one type are surrounded by a plurality of displayed enclosing symbols of the other type (and vice-versa) as described above. Here, the gaming system determines that: (a) the enclosing A symbol 720*p* and the enclosing C symbol 720*q* of the second group are surrounded by a plurality of enclosing symbols 720*e*, 720*f*, 720*g*, 720*h*, 720*r*, 720*bb*, 720*aa*, 720*z*, 720*y*, and 720*o* of the first group because the respective symbol display areas 710*e*, 710*f*, 710*g*, 710*h*, 710*r*, 710*bb*, 710*aa*, 710*z*, 710*y*, and 710*o* of those enclosing symbols of the first group form a continuous chain of adjacent symbol display areas that surround the symbol display areas 710*p* and 710*q* of the enclosing A symbol 720*p* and the enclosing C symbol 720*q* of the second group; (b) the enclosing Y symbol 720*v* and the enclosing X symbol 720*w* of the first group are surrounded by a plurality of enclosing symbols 720*k*, 7201, 720*m*, 720*n*, 720*x*, 720*hh*, 720*gg*, 720*ff*, 720*ee*, and 720*u* of the second group because the respective symbol display areas 710*k*, 710*l*, 710*m*, 710*n*, 710*x*, 710*hh*, 710*gg*, 710*ff*, 710*ee*, and 710*u* of those enclosing symbols of the second group form a continuous chain of adjacent symbol display areas that surround the symbol display areas 710*v* and 710*w* of the enclosing Y symbol 720*v* and the enclosing X symbol 720*w* of the first group; and (c) the enclosing A symbol 720*jj*, the enclosing C symbol 720*kk*, and the enclosing B symbol 72011 of the second group are surrounded by a plurality of enclosing symbols 720*y*, 720*z*, 720*aa*, 720*bb*, 720*cc*, 720*mm*, 720*ww*, 720*vv*, 720*uu*, 720*tt*, 720*ss*, and 720*ii* of the first group because the respective symbol display areas 710*y*, 710*z*, 710*aa*, 710*bb*, 710*cc*, 710*mm*, 710*ww*, 710*vv*, 710*uu*, 710*tt*, 710*ss*, and 710*ii* of those enclosing symbols of the first group form a continuous chain of adjacent symbol display areas that surround the symbol display areas 710*jj*, 710*kk*, and 710*ll* of the enclosing A symbol 720*jj*, the enclosing C symbol 720*kk*, and the enclosing B symbol 720*ll* of the second group.

The gaming system determines any awards associated with the surrounded non-enclosing symbols (if any). In this example embodiment, the gaming system determines: (a) an award of 2 credits for each surrounded enclosing C symbol and for each surrounded Z symbol, (b) an award of 5 credits for each surrounded enclosing B symbol and for each surrounded enclosing Y symbol, and (c) an award of 10 credits for each surrounded enclosing A symbol and for each surrounded enclosing X symbol. Here, the gaming system determines a total award of 44 credits associated with the surrounded enclosing symbols 720*p*, 720*q*, 720*v*, 720*w*, 720*jj*, 720*kk*, and 720*ll*, and displays the determined 44 credit total award in the award meter 790. The gaming system displays the following message in the message box 760: "YOU WIN 10 CREDITS FOR EACH SURROUNDED X AND EACH SURROUNDED A, 5 CREDITS FOR EACH SURROUNDED Y AND EACH SURROUNDED B, AND 10 CREDITS FOR EACH SURROUNDED C FOR A TOTAL AWARD OF 44 CREDITS!"

In certain embodiments, the plurality of different symbols associated with the slot game include one or more Wild symbols. In various embodiments, the Wild symbol may act as only a non-enclosing symbol, only an enclosing symbol, or either a non-enclosing symbol or an enclosing symbol. In one example embodiment including one set or group of enclosing symbols, when a displayed Wild symbol is surrounded by a plurality of displayed enclosing symbols, the displayed Wild symbol may act as any of the non-enclosing symbols (such as the non-enclosing symbol that would result in the highest award). In another example embodiment including one set or group of enclosing symbols, when a Wild symbol is displayed, the gaming system determines whether that displayed Wild symbol should act as any of the non-enclosing symbols or as an enclosing symbol based on whichever will result in the highest award. In one example embodiment including two sets or group of enclosing symbols of different types, each type of enclosing symbols is associated with its own separate Wild symbol. In another example embodiment including two sets or group of enclosing symbols of different types, the slot game is associated with at least one universal Wild symbol usable with both types of enclosing symbols.

In various embodiments, the plurality of symbols includes one or more Bonus symbols. In one example embodiment in which the Bonus symbols are non-enclosing symbols, when a designated quantity (such as one or three) of displayed Bonus symbols are surrounded by a plurality of enclosing symbols, the gaming system triggers a bonus feature, such as a play of a bonus game. In one embodiment, the triggered bonus feature differs based on how many displayed Bonus symbols are surrounded (e.g., the more displayed Bonus surrounded, the more valuable the Bonus). In certain instances, a plurality of displayed Bonus symbols may be separately surrounded. For example, a first displayed Bonus symbol is surrounded by a first plurality of displayed enclosing symbols and a second different displayed Bonus symbol is surrounded by a second different plurality of displayed enclosing symbols. In these instances, in one embodiment the gaming system combines or aggregates the bonus features associated with both surrounded Bonus symbols and provides the aggregated bonus features. In another embodiment, the gaming system provides an enhanced bonus feature (such as the aggregated bonus features with a modifier).

In another example embodiment in which the Bonus symbols are enclosing symbols, when a plurality of displayed Bonus symbols surround a designated quantity (such as one or three) of displayed non-enclosing symbols, the gaming system triggers the bonus feature. In one embodiment, the triggered bonus feature differs based on how many non-enclosing symbols the displayed Bonus symbols surround (e.g., the more displayed non-enclosing symbols surrounded, the more valuable the Bonus).

As described above, in various embodiments, the plurality of symbols employed for the slot game includes: (a) a plurality of enclosing symbols of a first type, and (b) a plurality of enclosing symbols of a second type. In certain such embodiments, the gaming system provides a special or enhanced award if a displayed enclosing symbol is doubly surrounded. For example, in one such embodiment, the gaming system determines an award if: (a) a displayed enclosing symbol of the first type is surrounded by a plurality of displayed enclosing symbols of the second type, and/or (b) a displayed enclosing symbol of the second type is surrounded by a plurality of displayed enclosing symbols of the first type. In this example embodiment, the gaming system determines a special award if: (a) a displayed enclosing symbol of the first type is surrounded by a plurality of displayed enclosing symbols of the second type and that plurality of displayed enclosing symbols of the second type is surrounded by a plurality of displayed enclosing symbols of the first type, and/or (b) a displayed enclosing symbol of the second type is surrounded by a plurality of displayed enclosing symbols of the first type and that plurality of displayed enclosing symbols of the first type is surrounded by a plurality of displayed enclosing symbols of the second type.

Figure 9:
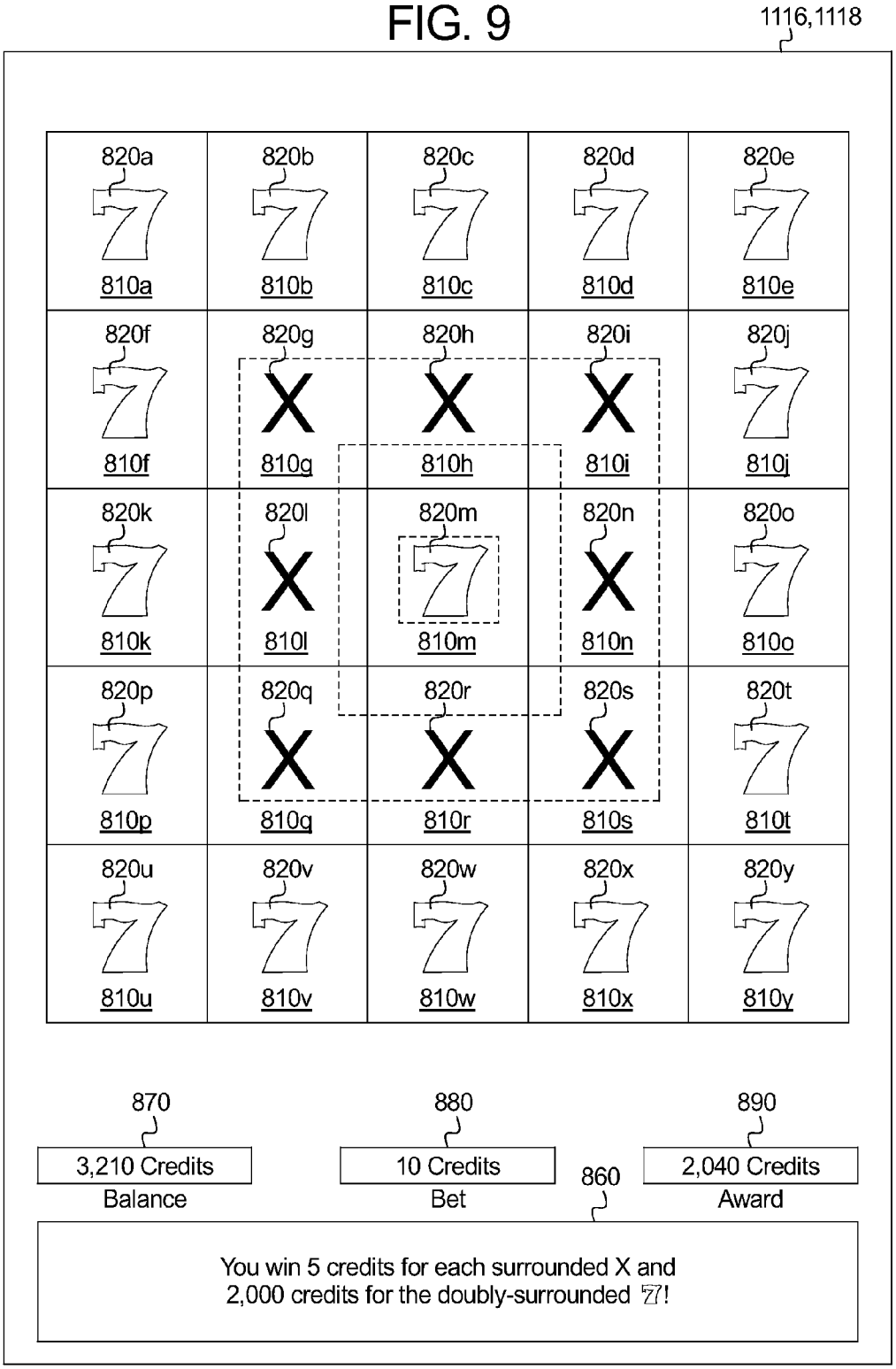
FIG. 9 illustrates a screenshot of an outcome of a play of another example embodiment of the slot game employing the surrounded symbol award evaluation.

FIG. 9 illustrates a screenshot of an outcome of a play of one such example embodiment of the slot game of the present disclosure implemented as a primary wagering game in which: (a) the slot game is associated with a plurality of different symbols including: (i) a first group or set of a plurality of enclosing X symbols (i.e., enclosing symbols of a first type); and (ii) a second group or set of a plurality of enclosing A symbols (i.e., enclosing symbols of a second type); and (b) the gaming system determines: (i) that a displayed enclosing symbol of the first group is surrounded by a plurality of displayed enclosing symbols of the second group when a continuous or unbroken chain of adjacent symbol display areas that each display an enclosing symbol of the second group surrounds the symbol display area of the displayed enclosing symbol of the first group; and (ii) that a displayed enclosing symbol of the second group is surrounded by a plurality of displayed enclosing symbols of the first group when a continuous or unbroken chain of adjacent symbol display areas that each display an enclosing symbol of the first group surrounds the symbol display area of the displayed enclosing symbol of the second group.

In this example embodiment, the gaming system displays a plurality of symbol display areas including symbol display areas 810*a*, 810*b*, 810*c*, 810*d*, 810*e*, 810*f*, 810*g*, 810*h*, 810*i*, 810*j*, 810*k*, 810*l*, 810*m*, 810*n*, 810*o*, 810*p*, 810*q*, 810*r*, 810*s*, 810*t*, 810*u*, 810*v*, 810*w*, 810*x*, and 810*y* arranged in a 5×5 grid or matrix. Each of the symbol display areas is configured to display one of the symbols. The gaming system also displays: (a) a message box 860 (described above); and (b) a plurality of meters including: (i) a credit meter 870 (described above), (ii) a wager or bet meter 880 (described above), and (iii) an award meter 890 (described above).

As noted above, the gaming system displays an outcome of a play of the slot game of this example embodiment (not listed for brevity). The gaming system determines whether any displayed enclosing symbols of one type are surrounded by a plurality of displayed enclosing symbols of the other type (and vice-versa) as described above. The gaming system also determines whether any displayed enclosing symbols are doubly surrounded as described above.

Here, the gaming system determines that: (a) the enclosing Seven symbol 820*m* is surrounded by a plurality of enclosing X symbols 820*g*, 820*h*, 820*i*, 820*n*, 820*s*, 820*r*, 820*q*, and 820*l* because the respective symbol display areas 810*g*, 810*h*, 810*i*, 810*n*, 810*s*, 810*r*, 810*q*, and 810*l* of those enclosing X symbols of the first group form a continuous chain of adjacent symbol display areas that surround the symbol display area 810*p* of the enclosing Seven symbol 820*m*; and (b) the enclosing X symbols 820*g*, 820*h*, 820*i*, 820*n*, 820*s*, 820*r*, 820*q*, and 820*l* are surrounded by a plurality of enclosing Seven symbols 820*a*, 820*b*, 820*c*, 820*d*, 820*e*, 820*j*, 820*o*, 820*t*, 820*y*, 820*x*, 820*w*, 820*v*, 820*u*, 820*p*, and 820*k* because the respective symbol display areas 810*a*, 810*b*, 810*c*, 810*d*, 810*e*, 810*j*, 810*o*, 810*t*, 810*y*, 810*x*, 810*w*, 810*v*, 810*u*, 810*p*, and 810*k* of those enclosing Seven symbols form a continuous chain of adjacent symbol display areas that surround the symbol display areas 810*g*, 810*h*, 810*i*, 810*n*, 810*s*, 810*r*, 810*q*, and 810*l* of the enclosing X symbols 820*g*, 820*h*, 820*i*, 820*n*, 820*s*, 820*r*, 820*q*, and 820*l*. The gaming system determines that the enclosing Seven symbol 820*m* is doubly surrounded because the enclosing Seven symbol 820*m* is surrounded by a plurality of displayed enclosing X symbols and that plurality of displayed enclosing X symbols is itself surrounded by a plurality of displayed enclosing Seven symbols.

The gaming system determines any awards associated with the surrounded non-enclosing symbols (if any). In this example embodiment, the gaming system determines: (a) an award of 5 credits for each surrounded enclosing X symbol and for each surrounded Seven symbol, and (b) a special award of 2,000 credits for each doubly-surrounded enclosing X symbol and for each doubly-surrounded enclosing Seven symbol. Here, the gaming system determines a total award of 2,040 credits associated with the surrounded enclosing X symbols and the doubly-surrounded enclosing Seven symbol, and displays the determined 2,040 credit total award in the award meter 890. The gaming system displays the following message in the message box 860: "YOU WIN 5 CREDITS FOR EACH SURROUNDED X AND 2,000 CREDITS FOR THE DOUBLY-SURROUNDED SEVEN!"

Figure 10:
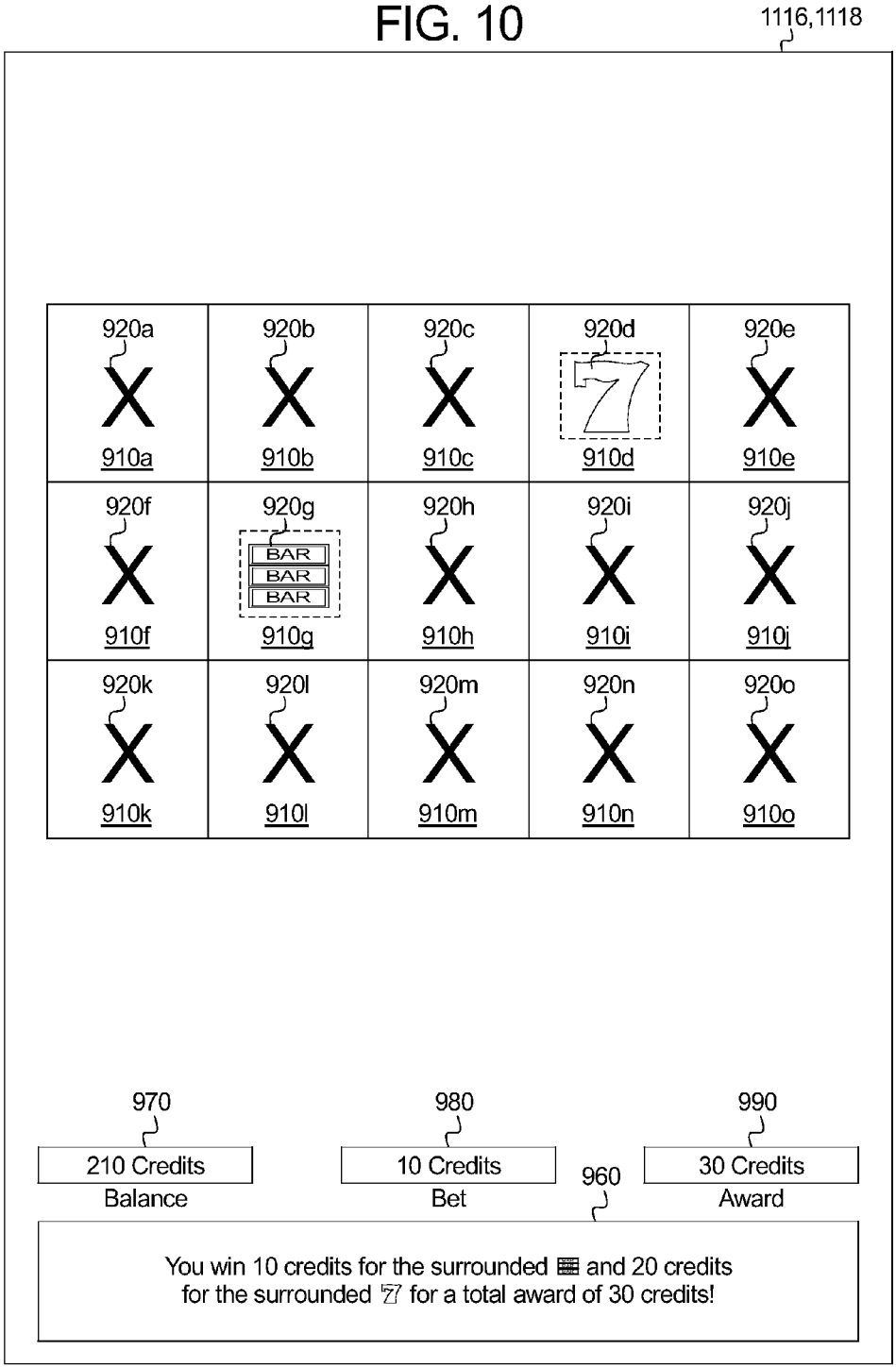
FIG. 10 illustrates a screenshot of an outcome of a play of another example embodiment of the slot game employing the surrounded symbol award evaluation.

FIG. 10 illustrates a screenshot of an outcome of a play of another example embodiment of the slot game of the present disclosure implemented as a primary wagering game. In this example embodiment, the gaming system determines that a displayed non-enclosing symbol is surrounded by a plurality of displayed enclosing symbols when: (a) if the symbol display area of the displayed non-enclosing symbol is not adjacent to a border of the grid or matrix of symbol display areas, a continuous or unbroken chain of adjacent symbol display areas that each display an enclosing symbol surrounds the symbol display area of the displayed non-enclosing symbol; and (b) if the symbol display area of the displayed non-enclosing symbol is adjacent to a border of the grid or matrix of symbol display areas, a combination of: (i) a continuous or unbroken chain of adjacent symbol display areas that each display an enclosing symbol, and (ii) the border of the symbol display area grid surround the symbol display area of the displayed non-enclosing symbol.

In this example embodiment, the slot game is associated with the plurality of different symbols described above with respect to FIG. 3A. In this example embodiment, the gaming system displays a plurality of symbol display areas including symbol display areas 910*a*, 910*b*, 910*c*, 910*d*, 910*e*, 910*f*, 910*g*, 910*h*, 910*i*, 910*j*, 910*k*, 910*l*, 910*m*, 910*n*, and 910*o* arranged in a 3×5 grid or matrix. Each of the symbol display areas is configured to display one of the symbols. The gaming system also displays: (a) a message box 960 (described above); and (b) a plurality of meters including: (i) a credit meter 970 (described above), (ii) a wager or bet meter 980 (described above), and (iii) an award meter 990 (described above).

As noted above, the gaming system displays an outcome of a play of the slot game of this example embodiment. In this instance, the gaming system displays: (a) enclosing X symbol 920*a* at the symbol display area 910*a*, (b) enclosing X symbol 920*b* at the symbol display area 910*b*, (c) enclosing X symbol 920*c* at the symbol display area 910*c*, (d) non-enclosing Seven symbol 920*d* at the symbol display area 910*d*, (e) enclosing X symbol 920*e* at the symbol display area 910*e*, (f) enclosing X symbol 920*f* at the symbol display area 910*f*, (g) non-enclosing Triple Bar symbol 920*g* at the symbol display area 910*g*, (h) enclosing X symbol 920*h* at the symbol display area 910*h*, (i) enclosing X symbol 920*i* at the symbol display area 910*i*, (j) enclosing X symbol 920*j* at the symbol display area 910*j*, (k) enclosing X symbol 920*k* at the symbol display area 910*k*, (l) enclosing X symbol 920*l* at the symbol display area 910*l*, (m) enclosing X symbol 920*m* at the symbol display area 910*m*, (n) enclosing X symbol 920*n* at the symbol display area 910*n*, and (o) enclosing X symbol 920*o* at the symbol display area 910*o*.

The gaming system determines whether any displayed non-enclosing symbols are surrounded by a plurality of displayed enclosing symbols, as described above. Here, the gaming system determines that: (a) the non-enclosing Seven symbol 920*d* is surrounded by the combination of a plurality of enclosing X symbols 920*e*, 920*j*, 920*i*, 920*h*, and 920*c* and the border of the 3×5 grid because: (i) the symbol display area 910*d* of the non-enclosing Seven symbol 920*d* is adjacent to the border; and (ii) the respective symbol display areas 910*e*, 910*j*, 910*i*, 910*h*, and 910*c* of those enclosing X symbols form a continuous chain of adjacent symbol display areas that, in combination with the border, surround the symbol display area 910*d* of the non-enclosing Seven symbol 920*d*; and (b) the non-enclosing Triple Bar symbol 920*g* is surrounded by a plurality of enclosing X symbols 920*a*, 920*b*, 920*c*, 920*h*, 920*m*, 920*l*, 920*k*, and 920*f* because the respective symbol display areas 910*a*, 910*b*, 910*c*, 910*h*, 910*m*, 910*l*, 910*k*, and 910*f* of those enclosing X symbols form a continuous chain of adjacent symbol display areas that surround the symbol display area 910*g* of the non-enclosing Triple Bar symbol 920*g*.

The gaming system determines any awards associated with the surrounded non-enclosing symbols (if any) as described above with respect to FIG. 3A. Here, the gaming system determines an award of 20 credits associated with the surrounded non-enclosing Seven symbol 920*d* and an award of 10 credits associated with the surrounded non-enclosing Triple Bar symbol 920*g*, and displays the determined 30 credit total award in the award meter 990. The gaming system displays the following message in the message box 960: "YOU WIN 10 CREDITS FOR THE SURROUNDED TRIPLE BAR AND 20 CREDITS FOR THE SURROUNDED 7 FOR A TOTAL AWARD OF 30 CREDITS!"

Although not shown, it should be appreciated that a non-enclosing symbol may be surrounded by multiple sides of the border and one or more enclosing symbols. For instance, if a non-enclosing symbol was displayed at the symbol display area 910 rather than the enclosing X symbol 920*o*, the gaming system would determine that that non-enclosing symbol is surrounded by the enclosing X symbols 920*j*, 920*i*, and 920*n* and the border of the 3×5 grid.

In certain such embodiments, for a given surrounded non-enclosing symbol, the gaming system determines the award associated with that surrounded non-enclosing symbol based on whether that non-enclosing symbol is surrounded by enclosing symbols and/or the border. For instance, in one example embodiment, the gaming system determines: (a) a first award if the symbol display area of the surrounded non-enclosing symbol is adjacent to the border of the grid of symbol display areas, and (b) a second different award (such as a higher award) if the symbol display area of the surrounded non-enclosing symbol is not adjacent to the border. In another example embodiment, the gaming system determines larger awards as the number of enclosing symbol surrounding that non-enclosing symbol increases. For instance, the gaming system determines a first award if the non-enclosing symbol is surrounded by the border and three enclosing symbols and a second higher award if the non-enclosing symbol is surrounded by the border and five non-enclosing symbols.

In certain embodiments, at least one of the enclosing symbols (or non-enclosing symbols, or bonus symbols, or wild symbols, or any other suitable symbols) is itself associated with an award, such as an award of credits, an award of a quantity of free plays of the slot game, or a modifier (such as a multiplier). In one embodiment, if the gaming system displays one of the enclosing symbols associated with an award, the gaming system provides that award to the player in addition to any awards associated with any surrounded displayed non-enclosing symbols. In another embodiment, if the gaming system displays one of the enclosing symbols associated with an award, the gaming system provides that award to the player if that displayed enclosing symbol is part of a plurality of displayed enclosing symbols that surround a displayed non-enclosing symbol.

In various embodiments, the slot game is associated with: (a) a plurality of enclosing symbols, (b) a plurality of non-enclosing symbols of a first type, and (b) a plurality of non-enclosing symbols of a second type. In these embodiments, the gaming system determines an award if a plurality of displayed enclosing symbols surround only displayed non-enclosing symbols of the first type or only displayed non-enclosing symbols of the second type. If, on the other hand, a plurality of displayed enclosing symbols surround displayed non-enclosing symbols of both types, the gaming system performs a different function, such as triggers a bonus feature.

In one such example embodiment, the slot game is associated with: (a) a plurality of enclosing symbols, (b) a plurality of non-enclosing hero symbols, and (c) a plurality of non-enclosing monster symbols. In this example embodiment, if a plurality of displayed enclosing symbols surround only displayed non-enclosing hero symbols, the gaming system determines an award based on the surrounded non-enclosing hero symbols. If, on the other hand, a plurality of displayed enclosing symbols surrounds at least one displayed non-enclosing hero symbol and at least one displayed non-enclosing monster symbol, the gaming system triggers a battle bonus feature. In this example embodiment, the quantity of surrounded non-enclosing hero symbols determines how many heroes the gaming system provides the player in the battle bonus feature and the quantity of surrounded non-enclosing monster symbols determines how many monsters the gaming system enables the player to battle in the battle bonus feature. For instance, if a plurality of displayed enclosing symbols surround one displayed non-enclosing hero symbol and three displayed non-enclosing monster symbols, the gaming system provides the player one hero to battle three monsters in the battle bonus feature (either at once or in three separate rounds). In another example, if a plurality of displayed enclosing symbols surround three displayed non-enclosing hero symbols and one displayed non-enclosing monster symbol, the gaming system provides the player three heroes to battle one monster in the battle bonus feature.

In certain embodiments, when a plurality of displayed enclosing symbols surround a plurality of displayed non-enclosing symbols, the gaming system determines the total award by multiplying the award values of any sets of two or more matching surrounded non-enclosing symbols and adding to that value the award values of any single surrounded non-enclosing symbols. In one example, if a plurality of displayed enclosing symbols surround three displayed Cherry non-enclosing symbols, the gaming system determines a total award of 8 credits (i.e., 2 credits×2 credits×2 credits). In another example, if a plurality of displayed enclosing symbols surround one displayed Cherry non-enclosing symbol and one displayed Seven non-enclosing symbol, the gaming system determines a total award of 22 credits (i.e., 2 credits+20 credits). In another example, if a plurality of displayed enclosing symbols surround one displayed Cherry non-enclosing symbol and two displayed Seven non-enclosing symbols, the gaming system determines a total award of 402 credits (i.e., 2 credits+(20 credits×20 credits)).

In various embodiments, the paytable includes award values associated with multiple surrounded matching non-enclosing symbols. For instance, in one example embodiment, the gaming system determines: (a) an award of 2 credits if a single displayed non-enclosing Bar symbol is surrounded by a plurality of displayed enclosing symbols, (b) an award of 10 credits if two displayed non-enclosing Bar symbols are surrounded by a plurality of displayed enclosing symbols, and (c) an award of 100 credits if three displayed non-enclosing Bar symbols are surrounded by a plurality of displayed enclosing symbols.

In certain embodiments, the paytable includes award values associated with multiple surrounded non-matching non-enclosing symbols. For instance, in one example embodiment, the gaming system determines: (a) an award of 500 credits if a displayed non-enclosing Triple Bar symbol, a displayed non-enclosing Double Bar symbol, and a displayed non-enclosing Bar symbol (in that particular order from left to right) are surrounded by a plurality of displayed enclosing symbols; (b) an award of 200 credits if a displayed non-enclosing Bar symbol, a displayed non-enclosing Double Bar symbol, and a displayed non-enclosing Triple Bar symbol (in that particular order from left to right) are surrounded by a plurality of displayed enclosing symbols; and (c) an award of 50 credits if a displayed non-enclosing Double Bar symbol, a displayed non-enclosing Triple Bar symbol, and a displayed non-enclosing Bar symbol (in that particular order from left to right) are surrounded by a plurality of displayed enclosing symbols.

In various embodiments, when at least two different pluralities of displayed enclosing symbols each surround a different set of one or more displayed non-enclosing symbols, the gaming system evaluates each surrounded set separately and sums the awards (if any) for each set to determine the total award. In other embodiments, when at least two different pluralities of displayed enclosing symbols each surround a different set of one or more displayed non-enclosing symbols, the gaming system collectively evaluates the surrounded non-enclosing symbols of each set (i.e., performs one surrounded symbol award evaluation including the surrounded symbols of all sets of surrounded non-enclosing symbols). In another embodiment, the gaming system performs an award evaluation in either of the above-described embodiments and employs a modifier associated with the quantity of sets (e.g., three sets is associated with a 3× multiplier).

It should be appreciated that the surrounded symbol award evaluation described herein may be employed with any suitable type of slot game having any suitable features or characteristics and is not limited to the example embodiments described herein. For example, the surrounded symbol award evaluation may be employed with any of the following slot games: (a) slot games including independent reels, (b) slot games including dependent reels, (c) slot games including a tumbling reels or cascading symbols feature, (d) slot game having a scatter-pay evaluation, (e) slot games having an end-to-end award evaluation, and (f) slot games including split symbols.

It should be appreciated that the surrounded symbol award evaluation described herein may be employed in addition to any other type of award evaluation. For example, the surrounded symbol award evaluation may be employed in addition to a payline evaluation or in addition to a ways-to-win evaluation.

While the above-described example embodiments are directed to gaming systems including video reels, it should be appreciated that gaming systems including mechanical reels may be configured to operate the slot game of the present disclosure having the surrounded symbol award evaluation.

It should be appreciated that:

(a) the quantity of symbol display areas;

(b) the configuration of the symbol display areas (e.g., a 3×3 matrix, a 4×4 matrix, a 5×5 matrix, a 3×5 matrix, etc.);

(c) the determination of whether a displayed non-enclosing symbol is surrounded by a plurality of displayed enclosing symbols;

(d) the paytable;

(e) how award amounts associated with surrounded non-enclosing symbols are determined; and/or (f) any other variables or determinations described herein may be: (1) predetermined; (2) randomly determined; (3) randomly determined based on one or more weighted percentages (such as according to a weighted table); (4) determined based on a generated symbol or symbol combination; (5) determined independent of a generated symbol or symbol combination; (6) determined based on a random determination by a central controller (described below); (7) determined independent of a random determination by the central controller; (8) determined based on a random determination at an EGM configured to operate the slot game (described below); (9) determined independent of a random determination at the EGM; (10) determined based on at least one play of at least one game; (11) determined independent of at least one play of at least one game; (12) determined based on a player's selection; (13) determined independent of a player's selection; (14) determined based on one or more side wagers placed; (15) determined independent of one or more side wagers placed; (16) determined based on the player's primary game wager or wager level; (17) determined independent of the player's primary game wager or wager level; (18) determined based on time (such as the time of day); (19) determined independent of time (such as the time of day); (20) determined based on an amount of coin-in accumulated in one or more pools; (21) determined independent of an amount of coin-in accumulated in one or more pools; (22) determined based on a status of the player (i.e., a player tracking status); (23) determined independent of a status of the player (i.e., a player tracking status); (24) determined based on one or more other determinations disclosed herein; (25) determined independent of any other determination disclosed herein; and/or (26) determined in any other suitable manner or based on or independent of any other suitable factor(s).

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 11A:
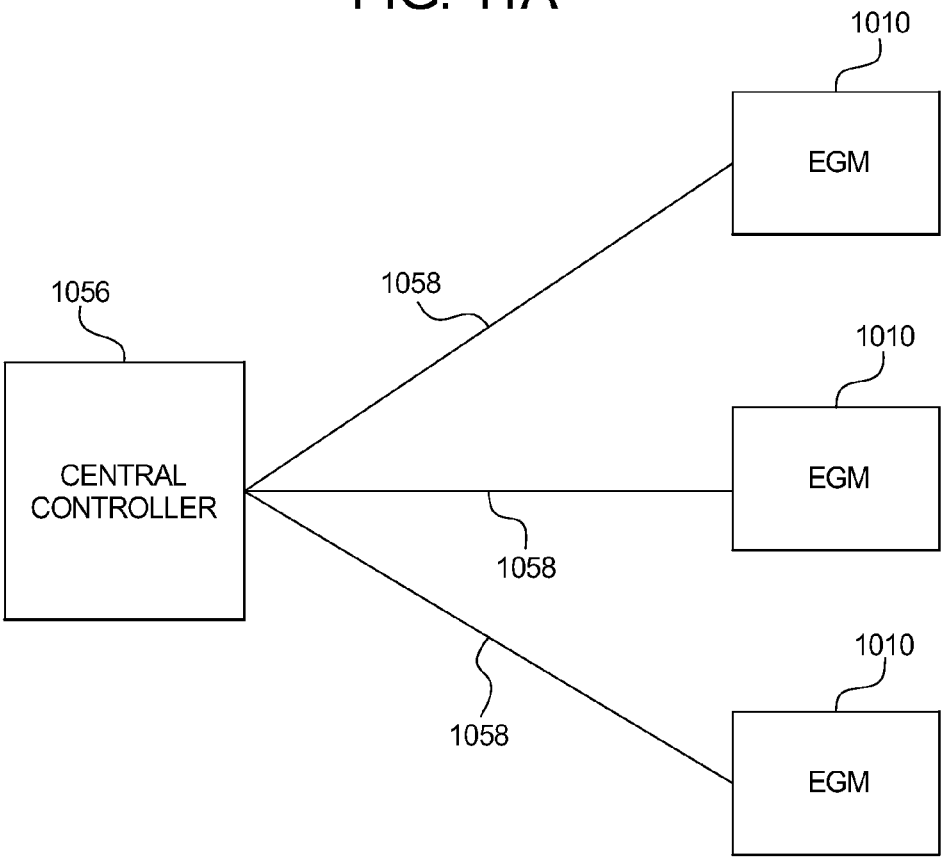
FIG. 11A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 11A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 11B:
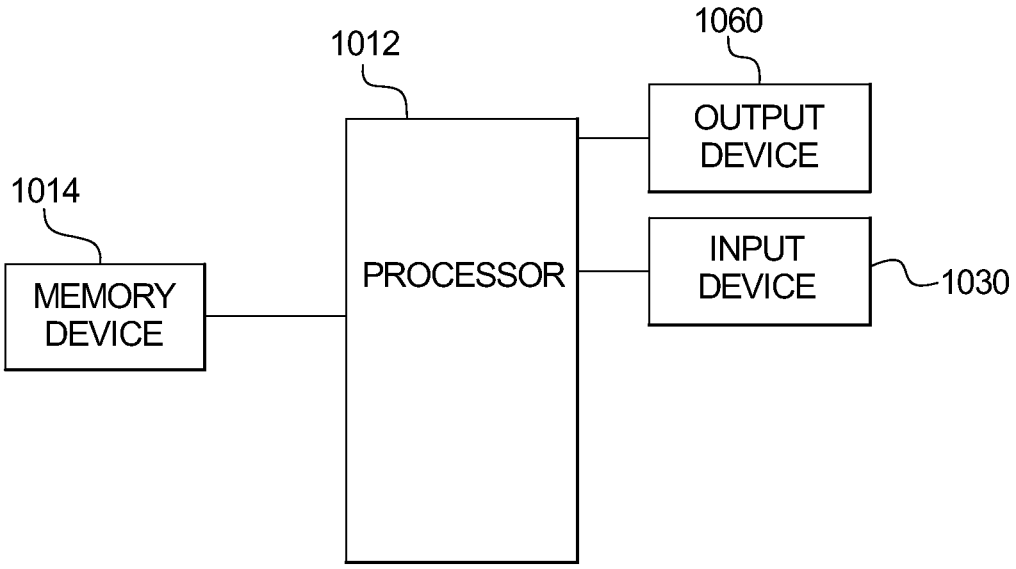
FIG. 11B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 11B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferroelectric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 11B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 12A:
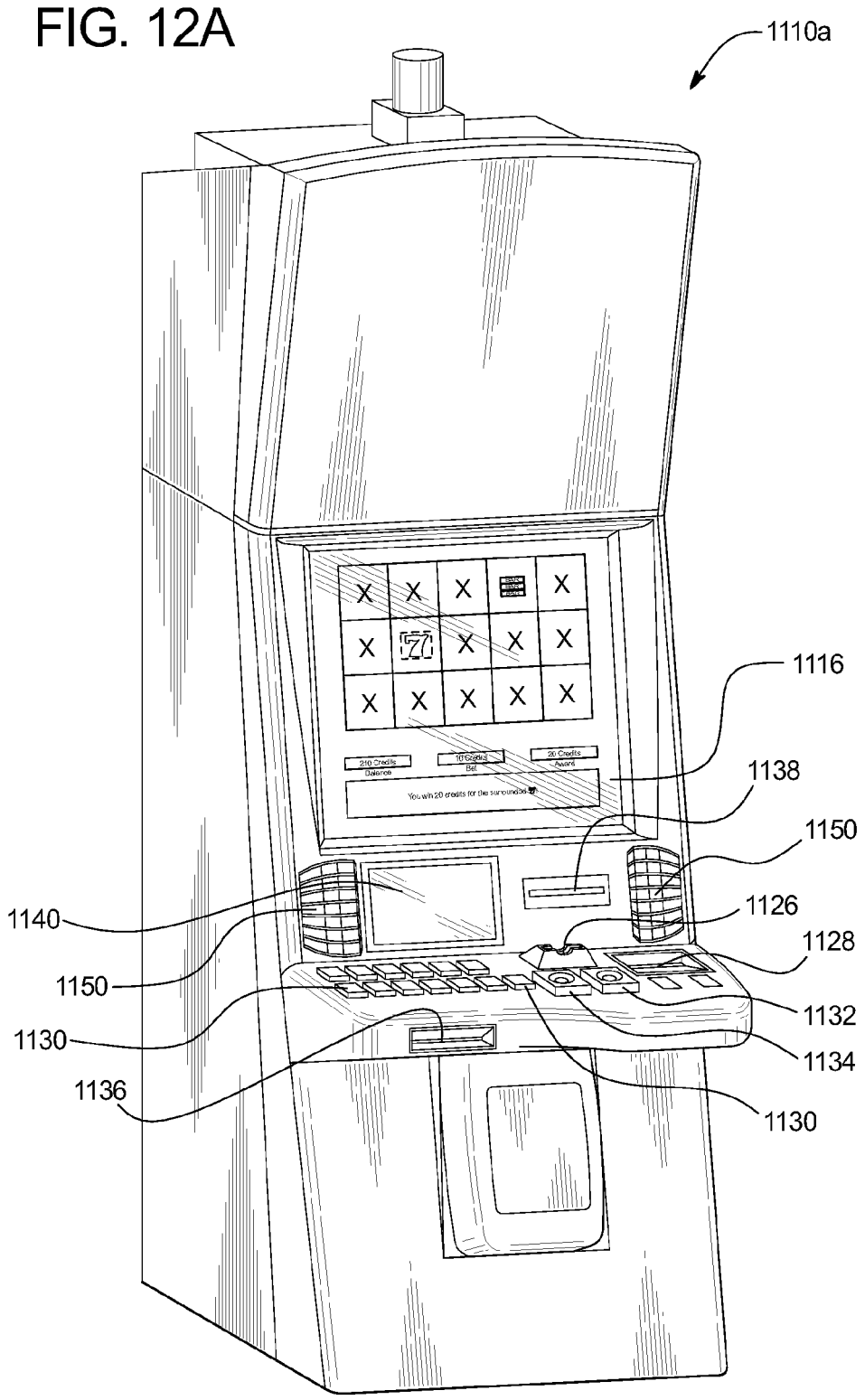
FIGS. 12A and 12B are perspective views of example alternative embodiments of the gaming system of the present disclosure.
Figure 12B:
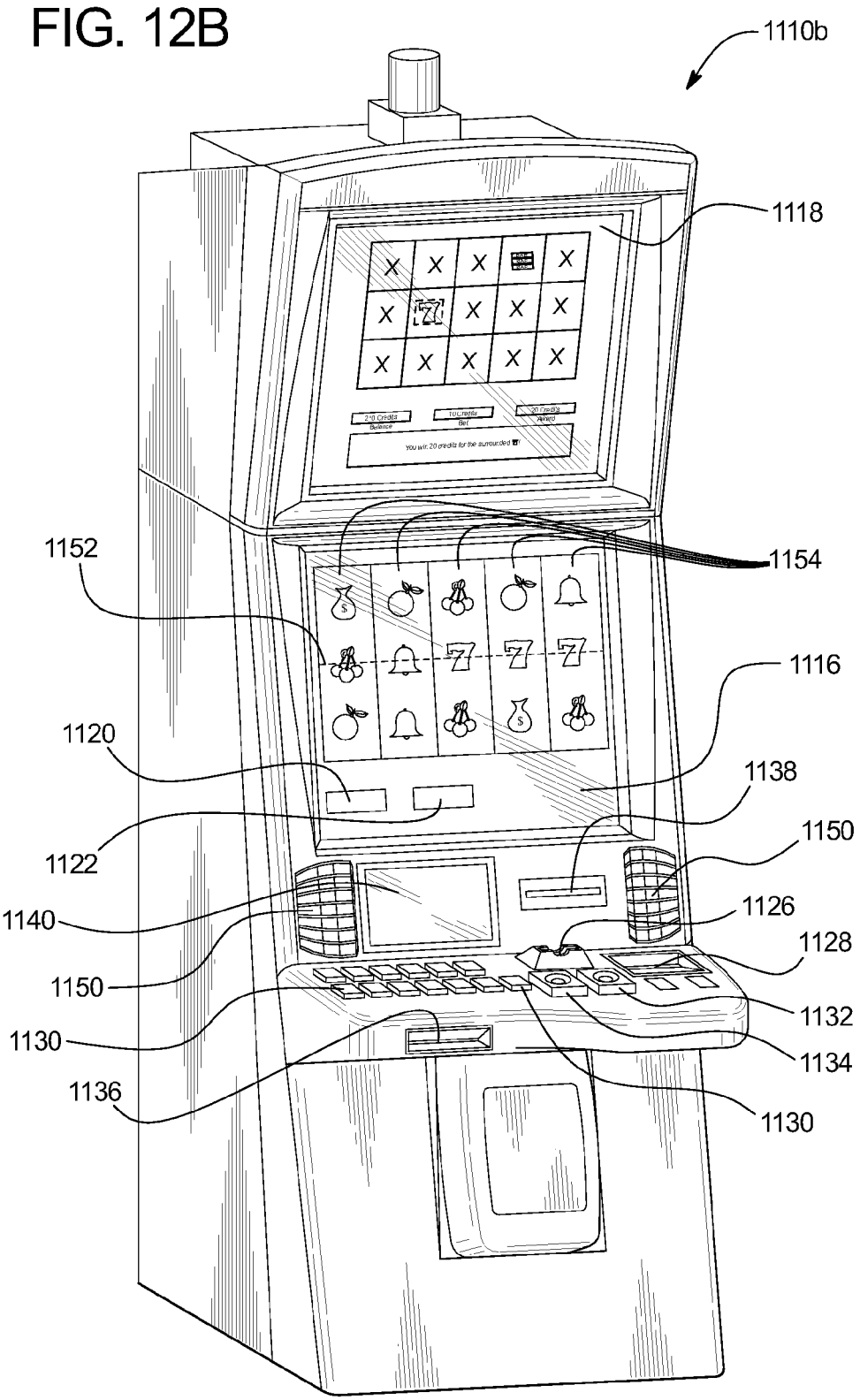

In various embodiments, the EGM includes one or more input devices. The input devices may include any suitable device that enables an input signal to be produced and received by the at least one processor of the EGM. The example EGM illustrated in FIG. 11B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 12A and 12B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 12A and 12B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 12A and 12B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 12A and 12B each include a card reader 1138. The card reader is configured to read a player identification card inserted into the card reader.

In various embodiments, the EGM includes one or more output devices. The example EGM illustrated in FIG. 11B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 12A includes a central display device 1116, a player tracking display 1140, a credit display 1120, and a bet display 1122. The example EGM illustrated in FIG. 12B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 12A and 12B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 12A and 12B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 12A and 12B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 12A and 12B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGM shown in FIG. 12B includes a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels.

In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game (s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one input device;

at least one display device;

at least one processor; and at least one memory device that stores a plurality of instructions which, when executed by the at least one processor, cause the at least one processor to operate with the at least one input device and the at least one display device, for a play of a game, to:

(a) display a plurality of symbol display areas;

(b) for each of the symbol display areas, display one of a plurality of different symbols at said symbol display area, the plurality of different symbols including a plurality of enclosing symbols and a plurality of non-enclosing symbols;

(c) determine whether any displayed non-enclosing symbols are surrounded by a plurality of displayed enclosing symbols; and (d) if at least one displayed non-enclosing symbol is surrounded by a plurality of displayed enclosing symbols: determine any awards associated with said at least one surrounded non-enclosing symbol, and (ii) display any determined awards.

2. The gaming system of claim 1, wherein the plurality of instructions, when executed by at least one processor, cause the at least one processor to determine that a displayed non-enclosing symbol is surrounded by a plurality of displayed enclosing symbols when a continuous chain of adjacent symbol display areas that each display an enclosing symbol surrounds the symbol display area of the displayed non-enclosing symbol.

3. The gaming system of claim 1, wherein an amount of any determined awards is based on a quantity of surrounded non-enclosing symbols.

4. The gaming system of claim 1, wherein the plurality of non-enclosing symbols includes a designated non-enclosing symbol, and the plurality of instructions, when executed by at least one processor, cause the at least one processor to provide a bonus if a plurality of displayed enclosing symbols surround a designated quantity of designated non-enclosing symbols.

5. The gaming system of claim 1, wherein the plurality of enclosing symbols includes a plurality of enclosing symbols of a first type and a plurality of enclosing symbols of a second different type.

6. The gaming system of claim 5, wherein the plurality of instructions, when executed by at least one processor, cause the at least one processor to determine that a displayed non-enclosing symbol is surrounded by a plurality of displayed enclosing symbols when either:

(a) a continuous chain of adjacent symbol display areas that each display one of the enclosing symbols of the first type surrounds the symbol display area of the displayed non-enclosing symbol; or (b) a continuous chain of adjacent symbol display areas that each display one of the enclosing symbols of the second type surrounds the symbol display area of the displayed non-enclosing symbol.

7. A method of operating a gaming system, said method comprising:

for a play of a game:

(a) causing at least one processor to execute a plurality of instructions stored in at least one memory device to operate with at least one display device to display a plurality of symbol display areas;

(b) for each of the symbol display areas, causing the at least one processor to execute the plurality of instructions to operate with the at least one display device to display one of a plurality of different symbols at said symbol display area, the plurality of different symbols including a plurality of enclosing symbols and a plurality of non-enclosing symbols;

(c) causing the at least one processor to execute the plurality of instructions to determine whether any displayed non-enclosing symbols are surrounded by a plurality of displayed enclosing symbols; and (d) if at least one displayed non-enclosing symbol is surrounded by a plurality of displayed enclosing symbols:

(i) causing the at least one processor to execute the plurality of instructions to determine any awards associated with said at least one surrounded non-enclosing symbol, and (ii) causing the at least one processor to execute the plurality of instructions to operate with the at least one display device to display any determined awards.

8. The method of claim 7, which includes causing the at least one processor to execute the plurality of instructions to determine that a displayed non-enclosing symbol is surrounded by a plurality of displayed enclosing symbols when a continuous chain of adjacent symbol display areas that each display an enclosing symbol surrounds the symbol display area of the displayed non-enclosing symbol.

9. The method of claim 7, wherein an amount of any determined awards is based on a quantity of surrounded non-enclosing symbols.

10. The method of claim 7, wherein the plurality of non-enclosing symbols includes a designated non-enclosing symbol, and which includes providing a bonus if a plurality of displayed enclosing symbols surround a designated quantity of designated non-enclosing symbols.

11. The method of claim 7, wherein the plurality of enclosing symbols includes a plurality of enclosing symbols of a first type and a plurality of enclosing symbols of a second different type.

12. The method of claim 11; which includes causing the at least one processor to execute the plurality of instructions to determine that a displayed non-enclosing symbol is surrounded by a plurality of displayed enclosing symbols when either:

(a) a continuous chain of adjacent symbol display areas that each display one of the enclosing symbols of the first type surrounds the symbol display area of the displayed non-enclosing symbol; or (b) a continuous chain of adjacent symbol display areas that each display one of the enclosing symbols of the second type surrounds the symbol display area of the displayed non-enclosing symbol.

13. The method of claim 7, which is provided through a data network.

14. The method of claim 13, wherein the data network is an internet.

15. A non-transitory computer readable medium storing a plurality of instructions which, when executed by at least one processor, cause the at least one processor to:

for a play of a game:

(a) cause at least one display device to display a plurality of symbol display areas;

(b) for each of the symbol display areas, cause the at least one display device to display one of a plurality of different symbols at said symbol display area, the plurality of different symbols including a plurality of enclosing symbols and a plurality of non-enclosing symbols;

(c) determine whether any displayed non-enclosing symbols are surrounded by a plurality of displayed enclosing symbols; and (d) if at least one displayed non-enclosing symbol is surrounded by a plurality of displayed enclosing symbols:

(i) determine any awards associated with said at least one surrounded non-enclosing symbol, and (ii) cause the at least one display device to display any determined awards.

16. The non-transitory computer readable medium of claim 15, wherein the plurality of instructions, when executed by at least one processor, cause the at least one processor to determine that a displayed non-enclosing symbol is surrounded by a plurality of displayed enclosing symbols when a continuous chain of adjacent symbol display areas that each display an enclosing symbol surrounds the symbol display area of the displayed non-enclosing symbol.

17. The non-transitory computer readable medium of claim 15, wherein an amount of any determined awards is based on a quantity of surrounded non-enclosing symbols.

18. The non-transitory computer readable medium of claim 15, wherein the plurality of non-enclosing symbols includes a designated non-enclosing symbol, and the plurality of instructions, when executed by at least one processor, cause the at least one processor to provide a bonus if a plurality of displayed enclosing symbols surround a designated quantity of designated non-enclosing symbols.

19. The non-transitory computer readable medium of claim 15, wherein the plurality of enclosing symbols includes a plurality of enclosing symbols of a first type and a plurality of enclosing symbols of a second different type.

20. The non-transitory computer readable medium of claim 19, wherein the plurality of instructions, when executed by at least one processor, cause the at least one processor to determine that a displayed non-enclosing symbol is surrounded by a plurality of displayed enclosing symbols when either:

(a) a continuous chain of adjacent symbol display areas that each display one of the enclosing symbols of the first type surrounds the symbol display area of the displayed non-enclosing symbol; or (b) a continuous chain of adjacent symbol display areas that each display one of the enclosing symbols of the second type surrounds the symbol display area of the displayed non-enclosing symbol.

21. The gaming system of claim 1, which includes a housing supporting the at least one input device and the at least one display device, wherein the at least one input device includes an acceptor and a validator, and wherein the plurality of instructions, when executed by the at least one processor, cause the at least one processor to operate with the at least one input device and the at least one display device to:

(A) if a physical item associated with a monetary value is received via the acceptor, identify, via the validator, the received physical item and establish a credit balance based at least in part on the monetary value associated with the received and identified physical item;

(B) if an actuation of a wager button is received, place a wager on said play of the game, the credit balance being decreasable by said wager and being increasable by any determined awards; and (C) if an actuation of a cashout button is received, initiate a payout associated with the credit balance.

22. The method of claim 7, which includes:

(A) if a physical item associated with a monetary value is received via an acceptor supported by a housing of the gaming system, identify, via a validator supported by the housing, the received physical item and causing the at least one processor to execute the plurality of instructions to establish a credit balance based at least in part on the monetary value associated with the received and identified physical item;

(B) if an actuation of a wager button is received, causing the at least one processor to execute the plurality of instructions to place a wager on said play of the game, the credit balance being decreasable by said wager and being increasable by any determined awards; and (C) if an actuation of a cashout button is received, causing the at least one processor to execute the plurality of instructions to initiate a payout associated with the credit balance.

23. The non-transitory computer readable medium of claim 15, wherein the plurality of instructions, when executed by the at least one processor, cause the at least one processor to:

(A) following receipt of a physical item associated with a monetary value via an acceptor and identification of the received physical item via a validator, establish a credit balance based at least in part on the monetary value associated with the received and identified physical item;

(B) if an actuation of a wager button is received, place a wager on said play of the game, the credit balance being decreasable by said wager and being increasable by any determined awards; and (C) if an actuation of a cashout button is received, initiate a payout associated with the credit balance.

* * * * *